US007543339B1

(12) United States Patent
Harris

(10) Patent No.: US 7,543,339 B1
(45) Date of Patent: Jun. 9, 2009

(54) MODULAR BIDET, CARTRIDGE BASED LIQUID DISPENSER AND BLOW-DRYER SYSTEM

(76) Inventor: Robert Marion Harris, P.O. Box 1227, Roseville, CA (US) 95678-8227

( * ) Notice: Subject to any disclaimer, the term of this patent is extended or adjusted under 35 U.S.C. 154(b) by 0 days.

(21) Appl. No.: 12/036,386

(22) Filed: Feb. 25, 2008

(51) Int. Cl.
*A47K 3/022* (2006.01)

(52) U.S. Cl. ..... 4/445; 4/420.5

(58) Field of Classification Search ..... 4/443, 4/445, 420.5–420.1
See application file for complete search history.

(56) References Cited

U.S. PATENT DOCUMENTS 2,707,467 A * 5/1955 Karp et al. ..... 604/259
4,371,993 A * 2/1983 Patrick ..... 4/448
6,076,199 A * 6/2000 Na ..... 4/420.4

* cited by examiner

*Primary Examiner*—Huyen Le

(57) ABSTRACT

A modular system consisting of a hand-held bidet, a cartridge based liquid dispenser and a blow-dryer that are concealed inside a single cabinet. Separate cabinets can also be utilized for each of the subassemblies, thus allowing them to be used together in any combination together or independently of each other. This unique system mounts onto a standard water tank, and is shaped to match the tank so that it blends well with the existing toilet design to make it inconspicuous for discretion and aesthetics. The bidet assembly uses a built-in, on-demand hot water apparatus, a mixing water valve unit and an electronic control device. The liquid dispensing assembly uses a replaceable and refillable cartridge that provides for a means to add medicinal or cleansing solutions to the bidet spray. The blow-dryer assembly allows the use of any standard hand-held blow-dryer and is used for personal drying after bidet use.

13 Claims, 17 Drawing Sheets

MODULAR BIDET, CARTRIDGE BASED LIQUID DISPENSER AND BLOW-DRYER SYSTEM

CROSS-REFERENCE TO RELATED APPLICATIONS

This application claims the benefit of U.S. Patent Application No. 12036238, which was filed on Feb. 23, 2008 and entitled "Modular Cartridge Based Liquid Dispenser System For Toilets And Bidets" by the present inventor.

FEDERALLY SPONSORED RESEARCH

Not Applicable

SEQUENCE LISTING OR PROGRAM

Not Applicable

BACKGROUND

1. Field of the Invention

The present invention relates in general to hygienic devices and more specifically, a modular bidet system consisting of a bidet, a cartridge based liquid dispenser and blow-dryer assembly that is mounted on a standard toilet water tank.

2. Description of the Prior Art

Bidets have not been widely accepted in the United States, in spite of the many benefits. Bidets provide enhanced personal cleanliness and help can minimize the use of toilet paper which is an increasing ecological concern.

Bidets with special spray nozzle attachments can be used to cleans internal body cavities to perform douches or enemas. Bidet accessories can be used to administer cleaning or medical solution to said body cavities as well.

Many people find that a doctor recommends they either rinse or soak following surgery procedures in the genital and rectal areas, such as after an episiotomy or a hemorrhidectomy. Further, medicines may need to be added to the rinse or soak water. The usual way to accomplish this is by immersion in a tub. A bidet device that would allow rinsing and medicating of the genital and rectal areas without immersion in a tub would be desirable.

Currently, there is a variety of bidet designs that are available to the consumer. However, a number of shortcomings are seen in these prior art bidet devices.

The most common bidets are stand-alone units that are prominently and permanently installed in bathrooms, requiring additional bathroom floor space and appropriate separate plumbing to install. These bidets are large, the size of toilets, and thus cannot be added to an existing structure without extensive remodeling. Costs are therefore very high for installation. Thus there are few homes in the United States having bathrooms with either plumbing or floor space provisions adequate for the installation of bidets.

As an alternative, some designers have developed portable bidet units that can be used in conjunction with an existing toilet. However, these portable units are typically bulky and awkward to use. Portable bidet devices that have been created have proven to be difficult to install, and/or unsightly once installed. Portable bidets need to be connected to the faucet each time it is to be used and then to disconnect it after use is an awkward procedure which results in considerable inconvenience and deters persons from using the bidet. These devices usually require that the bidet basin be stored when not in use.

The majority of the other prior art bidets have sprayers added to the existing toilet systems. The spray nozzles are placed around the toilet in permanent methods, having many drawbacks:

1) The bidet sprayer is built into the basin and thus originates from a fixed location. The fixed nozzle leaves the user with no control over the application of cleansing water. Consequently, the bidet spray cannot be directed at a particular location and cannot be redirected if desired. Because of the immobility of the sprayer nozzle, some of them require the user to maintain a specific body alignment to obtain better cleansing.
2) Some devices provide a nozzle located some distance below the seat which requires reaching down into the bowl to obtain adjustment of the spray.
3) Some bidets that do have movable nozzles still have very minimal spray patterns.
4) Many of these devices are characterized by an undue level of mechanical complexity which may affect their reliability, the mechanisms and moving parts of the said combinations are unsightly, exposed and cumbersome.
5) Special seats that have nozzles located inside the toilet bowl modify the appearance of the toilet.
6) Many devices have need of frequent sanitation because the nozzles stay inside the bowl when used.
7) Their proximity to the toilet bowl make them difficult to clean, and may cause unpleasant odors.

Some bidet devices include a hand-held nozzle that offers a maximum of utility, allowing the user to direct the spray. Most hand-held bidets that are mounted on or adjacent to the toilet are stored out in the open. Some have a volume control that is attached to a sink faucet with a flexible hose, where the volume and temperature controls are often not accessible to the toilet. They can be obtrusive, significantly affecting appearance or use of the toilet.

A bidet device suitable for retrofit installation to existing toilet fixtures, or original installation into manufactured fixtures that is easily installed, inexpensive does not detract from the aesthesis of the bathroom would be highly desirable.

Therefore, it can be appreciated that there exists a continuing need for a new and improved heated bidet attachment for a toilet device that can be used for providing a personal hygiene device having a warm water spray and further being connected with the existing toilet. In this regard, the present invention substantially fulfills this need.

OBJECTS AND ADVANTAGES

One object of the present invention is to provide a bidet which serves as cleansing equipment for personal hygiene.

A further object of the invention to provide a bidet device that does not require a second commode or basin to be installed.

A further object of the invention is to provide a device that offers a warm water spray with temperature control.

It is still yet another object of the invention to provide a multi-featured bidet device for dispensing medicating solutions to the genital and rectal areas.

A further object of the invention is to provide an apparatus that can use a safe and sanitary nozzle for body treatments.

A further object of the present invention to provide a bidet that does not require extensive plumbing when installed in an existing structure.

A further object of the invention is to provide such a system which can be easily installed by a homeowner without the necessity of employing a professional plumber.

A further object of the invention is to present an add-on bathroom fixture to provide convenience of use that is attractive when installed without appearing obtrusive.

A further object of the present invention is to provide equipment that will have universal application to a wide variety of existing installed toilets.

A further object of this invention is for it to be easily added to an existing toilet and just as easily removed again, such as would be desired by apartment dwellers.

An even further object of the present invention is to provide a new bidet apparatus which is susceptible of a low cost of manufacture with regard to both materials and labor, and which accordingly is then susceptible of low prices of sale to the consuming public, thereby making such bidet apparatus economically available to the buying public.

Lastly, it is an object of the present invention, while achieving the above stated objectives, is to provide a bidet having a protective housing which provides ready storage of the apparatus and permits ready removal, usage and concealed restorage.

SUMMARY OF THE INVENTION

In the view of the foregoing disadvantages inherent in the known types of toilet devices and accessories now present in the prior art, the present invention provides an improved bidet attachment for a toilet. As such, the general purpose of the present invention, which will be described subsequently in greater detail, is to provide a new and improved bidet attachment for a toilet that has all the advantages of the prior art and none of the disadvantages.

The present invention accomplishes the above-stated objectives, as well as others, as may be determined by a fair reading and interpretation of the entire specification.

Modular Cabinet:

The present invention is designed to take advantage of the unused space that exists directly above the average toilet water tank for the placement of a modular bidet system. This invention utilizes a unique modular cabinet designed to be strategically placed onto the top rim of a standard toilet's water tank. It is shaped to blend in with the design of the water tank for aesthetics. The bottom of the cabinet has guides so that the cabinet can fit well on a variety of water tank sizes. The top of the cabinet is a rim just like that of the water tank to allow the original toilet's lid to be re-installed. This allows the stock toilet lid to be reused so that the general design of the toilet can be maintained and to help the cabinet to blend into the existing bathroom decor. This modular design allows other modular cabinets or special purpose cabinets to be installed onto it. The cabinet can have its own custom lid as well. This modular cabinet provides the housing and space for the components of the bidet system, which includes a bidet device with a hose reel and water sprayer, a cartridge based liquid dispenser for dispensing of cleaning solutions or medicines to the bidet sprayer, and a blow-dryer. This is an apparatus that can either be attached to an existing toilet as an aftermarket product or manufactured in combination with a new toilet.

The bidet, cartridge based liquid dispenser and blow-dryer could each reside inside separate modular cabinets, or could be assembled in any combination. This would allow the consumer to choose which assemblies to install. For example, a consumer may not desire to use the cartridge based liquid dispensing element, so a cabinet could be made available that omits it. Later, if the consumer then desires to have the cartridge based liquid dispenser, a separate modular cabinet that contains one could be added to the base assembly.

Another feature of the modular nature of this invention is that other components can be attached or stacked onto the top of it to add yet other unique features, allowing it to work with other modular devises under development by the same inventor. Although the additional features can be also built into just one modular cabinet, for the sake of modularity, some additional devices may be best kept as separate devices, similar to a component stereo system.

Bidet System:

The modular bidet cabinet system is mounted on the water tank, within easy reach behind a person using the toilet. A swing door on the front of the cabinet opens to gain access to a compartment containing a retractable hand-held bidet sprayer. As the water hose that feeds this sprayer utilizes a tensioned reel, the user only has to easily withdraw the sprayer to the desired area of the body part to be sprayed. The automatic reel mechanism will lock the hose, preventing it from recoiling. The hand-held spray head can then be directed at any desired area or areas which are to be washed. The sprayer, similar to a garden hose sprayer, has a finger control lever that starts and stops the flow of water as well as allow for the volume and spray pattern to be administered. If desired, the sprayer can also be hung from a hook or cradle that can be mounted on the bidet sprayer door or on a nearby wall. With only a gentle tug on the bidet hose, the automatic reel mechanism allows the bidet sprayer and hose to be conveniently reeled back inside the modular cabinet.

The bidet system is designed with a rapid hot water device and electronically controlled mixing valves that enable a user to control the temperature of the water. It is generally known that sensitivity to temperature is subjective to each individual and, therefore, the present invention allows an electronic control to exactly adjust the temperature of the water to be sprayed. A temperature control unit with a digital readout of the water temperature is conveniently located at the end of the hose, between the hose and the sprayer. This allows the person to select the desired water temperature of the spray, and also monitor the temperature of the water being dispensed, so that the correct temperature is known before contacting the user. For example, it may take a few moments for the mixing valves to operate and receive feedback from the sprayer's temperature probe for a specified water temperature to be reached. A user only has to spray the water into the toil bowel until the desired temperature is reached. The electronic control could beep when the exact temperature water is available. The user is then confident to spray the water onto the user's body parts. Buttons are available on the controller to allow multiple users to store favorite temperature settings.

Cartridge Based Liquid Dispenser System:

The present invention allows a cleaning liquid or medicine solution to be mixed with the bidet water stream. It is a unique cartridge based liquid dispenser that is also built into the bidet cabinet. The removable cartridge is designed with a cap so that it can be filled with any desired liquid. A user simply removes the cartridge from the cabinet to add any desired solution into it, such as cleaning fluid or medicinal solution. The cartridge is then reinserted into the modular cabinet where the cartridge docks with a liquid pumping unit. A spring-loaded orifice in the cartridge allows the liquid to enter a mating orifice in the liquid pump. The pump then transfers the liquid from the cartridge to an electronically controlled mixing valve which regulates the amount of liquid to be discharged to the bidet sprayer.

A programmable electronic controller allows the user full control of the liquid mixing valve, including the two other mixing valves that are used to mix hot and cold water. This provides the user the ability to dispense any desired ratio of liquids from the valves so that any desired measure of cold water, hot water or liquid additive can be delivered to the sprayer. For example, an ordinary premixed douche solution could be purchased and added to the cartridge. As this solution is already premixed, it may be desired to administer the solution undiluted by the hot or cold water supplies. Therefore, the controller would only activate the mixing valve for the liquid cartridge supply, allowing only the liquid from the cartridge to be pumped to the sprayer. A user could also choose to add pure vinegar (a common douche solution) to the cartridge and set the controller to mix the vinegar with warm water at an appropriate ratio. Likewise, medicine solutions may be used full strength or diluted this way as desired.

The electronic bidet controller has several programmable buttons, which would allow a user to apply a solution to be dispensed from the cartridge and mixed with warm water as long as the button is depressed. Once the button is released, the solution would be turned off to allow only warm water to be dispensed. This is desirable for the case of administering a cleansing solution to the body for a brief time interval.

The cartridges may be made to be disposable as well. The present invention offers the ability to provide the consumer with commercially available disposable cartridges that can contain any desired solutions, such as sterile medicines, douches or soaps as mentioned above. Once the cartridge's product has been consumed, the user simply disposes it. A cartridge based liquid container for a bidet provides for a number of advantages and options, such as:

1) Convenient Access: The replaceable cartridge is inserted into a slot in the front of the modular cabinet, behind an access panel. This position allows the user easy reach to service the unit.
2) Convenient Packaging to Reduce Mess: The cartridge is a convenient, leak free container for liquids, allowing the user to handle it without coming in contact with the liquid inside. The cartridge contains a small, spring-loaded liquid valve that is normally closed to prevent any leakage while the cartridge is removed from the cabinet. The liquid valve automatically opens when the cartridge is simply inserted into the cabinet.
3) User Choice of Liquids: A refillable cartridge provides a user the ability to utilize any desired kind of cleaning solution, medicine or other liquid.
4) Convenience of Service: An optional disposable cartridge allows the user the convenience of simply discarding a spent cartridge. This relieves the user from the task of refilling the cartridge and from the potential of making a mess. A user has only to flip down a convenient access door on the front panel of the cabinet, pull out and discard a spent cartridge and then simply insert a fresh cartridge into the device.
5) Solution Level Indication: A cartridge made of a transparent or semitransparent material would allow a user to visually see the fluid level inside the cartridge simply by glancing at it, thereby allowing the user to know how much fluid remains in the cartridge. An optional electronic fluid level detector could also be used sense the level of the liquid inside the cartridge and then provide feedback for the user, whereby the controller could flash a lamp and/or signal a beeper to occasionally chirp to indicate a low fluid level condition.

The present invention's feature of utilizing a removable cartridge also allows the consumer to own a plurality of cartridges for the purpose of storing different types of solutions. This provides the user with the convenience of only having to select the desired cartridge and then insert it into the modular cabinet without having to empty and then refill a single cartridge each time a different solution is desired.

The current invention also allows the use of multiple liquid cartridge dispensers to be installed into the modular cabinet, thus allowing the user the ability to select from a variety of solutions without having to swap out different cartridges from a single dispenser unit. For example, a dual-cartridge unit would allow one cartridge to contain a basic cleaning solution while the second cartridge can contain a medicinal solution. The current invention utilizes a single electronic controller that is designed to allow each cartridge to be independently programmed and controlled. Each fluid can be separately programmed for the amount of liquid to be dispensed.

Hot Air Blow-Dryer System:

The present invention utilizes an optional hand-held blow-dryer assembly that allows the bidet user to dry off after having a bidet rinse, which reduces the need for toilet paper. The modular bidet cabinet system is mounted on the water tank, within easy reach behind a person using the toilet. The present invention provides a compartment inside the modular cabinet to house this blow-dryer. A tensioned reel is utilized to keep the blow-dryer's cord coiled and hidden inside the cabinet. A swing door on the front of the cabinet opens to gain access to the retractable blow-dryer. As the blow-dryer utilizes a tensioned reel, the user only has to easily withdraw the blow-dryer to the desired area of the body part to be dried. The automatic reel mechanism will lock the hose, preventing it from recoiling. The blow-dryer can then be directed at any desired area or areas which are to be dried. If desired, the blow-dryer can be hung from a hook or cradle that can be mounted on the blow-dryer door or on a nearby wall. The blow-dryer is attached to a hose reel, that is spring loaded so that it can conveniently reel the cord and blow-dryer back inside. A gentle tug on the cord will allow it to be automatically recoiled back into the cabinet.

The present invention is designed to utilize a standard design electric hot-air blow-dryer. This ability allows the consumer the choice of virtually any type of commercial hair-dryer. A top panel of the modular bidet cabinet could be removed to reveal the blow-dryer compartment. A standard blow-dryer could be plugged into a power cord plug as protruding from the cord reel. The blow-dryer's cord can then be wound around the reel and then placed into the compartment. It is then ready for use.

The hand-held blow-dryer system is designed as optional accessory to the bidet cabinet but can also be provided inside its own separate, modular cabinet. This would allow the blow-dryer system to be added onto an existing bidet cabinet at any time. A separate blow-dryer system could also by itself without the bidet product, since it would still provide a convenient place to store a hair-dryer, which is a common bathroom item.

Sanitary Operation:

Some prior art utilize spray nozzles that reside inside the toilet bowl area, where they can become easily contaminated, considering the normal environment of the bowl. Upon activation of said nozzle, water with contaminates could be sprayed onto the body. Most people would not desire to spray this contaminated water onto their bodies, especially in the groin area. The current invention removes the spray nozzle from the unsanitary bowl environment to the dry and sanitary storage inside the modular bidet cabinet. There are no components mounted in the toilet bowl or on the seat, and the bidet can thus be used in a hygienic manner. No frequent sanitation of the device is necessary.

The hand-held sprayer also allows the device to hygienically administer liquid to internal body cavities. A disposable nozzle attachment can be simply applied to the end of the water sprayer to allow the user to insert it into the body. After use, the nozzle attachment can be removed and disposed of.

Bathroom and Toilet Aesthetics:

One object of the current invention is to provide the most inconspicuous and unobtrusive device as to maintain look the traditional bathroom. The current invention achieves this by the previously mentioned features: The present invention fully conceals the bidet, cartridge based liquid dispenser and blow-dryer components inside a modular cabinet that is shaped to fit and blend in with the existing toilet design, making it inconspicuous. The unit is very compact so it occupies little space, which is often at a premium in crowded bathroom areas. The added cabinet does not detract appreciably from the appearance of the water closet. The aesthetics of the toilet then appear normal, with the appearance of only a slightly taller than usual water tank. This modular cabinet also utilizes the original stock water tank lid to better preserve the original toilet aesthetics. The modular cabinet could be provided with its own detachable lid, but reusing the existing toilet water-tank lid would retain the original look of the toilet.

Ease of Installation:

It is another object of this invention to provide an apparatus capable of easy installation onto an existing toilet tank of generally standard design that requires no alterations in the toilet. Another goal of this invention is for it to be easily added to an existing toilet and just as easily removed again, such as would be desired by apartment dwellers. The current invention accomplishes this through a very simple design that allows it to be easily installed or uninstalled on conventional toilet tank structures requiring no professional skill or special tools for installation. The modular cabinet is simply sat down in place on top of the water tank. This position also allows easy installation of the device as it merely sits on the water-tank, using no fasteners. Guides on the cabinet's bottom mates with the water-tank's rim to keep the cabinet securely in place. The top of the modular cabinet has a rim just like the water tank so that the original lid can be attached to it. This modular design allows it to be easily removed so that quick service to the components inside the water-tank can be made, such as freeing up a stuck flush valve. The only plumbing alteration that is required is the addition of an incoming cold water tap line. Thus, the toilet bidet of this invention does not require a complicated connection to a hot water line.

Ease of Use:

The present invention is a modular cabinet and mounted on the water tank, within easy reach behind a person using the toilet. Swing doors on the front of this cabinet allow the user to easily extract the bidet sprayer or blow-dryer for use. A light tug on them allows mechanisms to automatically recoil them back into the cabinet for inconspicuous and hygienic storage.

Universal Applications:

A further object of the present invention is to provide equipment that will have universal application to a wide variety of existing installed toilets. The current invention achieves this objective by its modular nature as it can be shaped to fit any water tank. The component of this invention requiring the concern for universal application is the mainly the shape of the water tank mounted modular cabinet and its mounding element. This modular cabinet can be shaped to perfectly fit each different model toilet which also allows it to blend in for aesthetics. This modular cabinet could also be offered in a generic cabinet shape or skin that is designed to work on and look good with a wide range of brands and models, thus enhancing the ability to more widely use this product on existing toilets.

Customization:

The present invention's bidet system is designed with a replaceable sprayer to allow the attachment of most commercially available sprayers. This allows the consumer to choose a sprayer that has a specific desired size, shape or spray pattern.

The present invention's blow-dryer system is designed to utilize a standard design electric hot-air blow-dryer. This ability allows the consumer the choice of virtually any type of commercial hair-dryer.

Economic Design:

A particularly important advantage of the present invention that it can be constructed from readily available parts so that its cost is reduced in comparison to more complicated devices which require special toilet bowls, special water tanks or other specialized components. The bidet hose reel and blow-dryer cord reel are commonly available products. The hand-held bidet sprayer is of standard design, thus allowing most available bidet sprayer to be utilized. Even garden hose sprayers could be used. The blow-dryer assembly utilizes a standard hair-dryer style device. Thus, the present invention can be economically manufactured.

Conclusion:

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

The above mentioned objectives and advantages of this invention and the manner of attaining them will become more apparent and the invention itself will be best understood by reference to the following detailed descriptions of the invention taken in conjunction with the accompanying drawings.

BRIEF DESCRIPTION OF THE DRAWINGS

Various other objects, advantages, and features of the invention will become more readily apparent to those skilled in the art from the following detailed description when read in conjunction with the accompanying drawings, in which.

DRAWINGS

Reference Numerals

Figure 1:
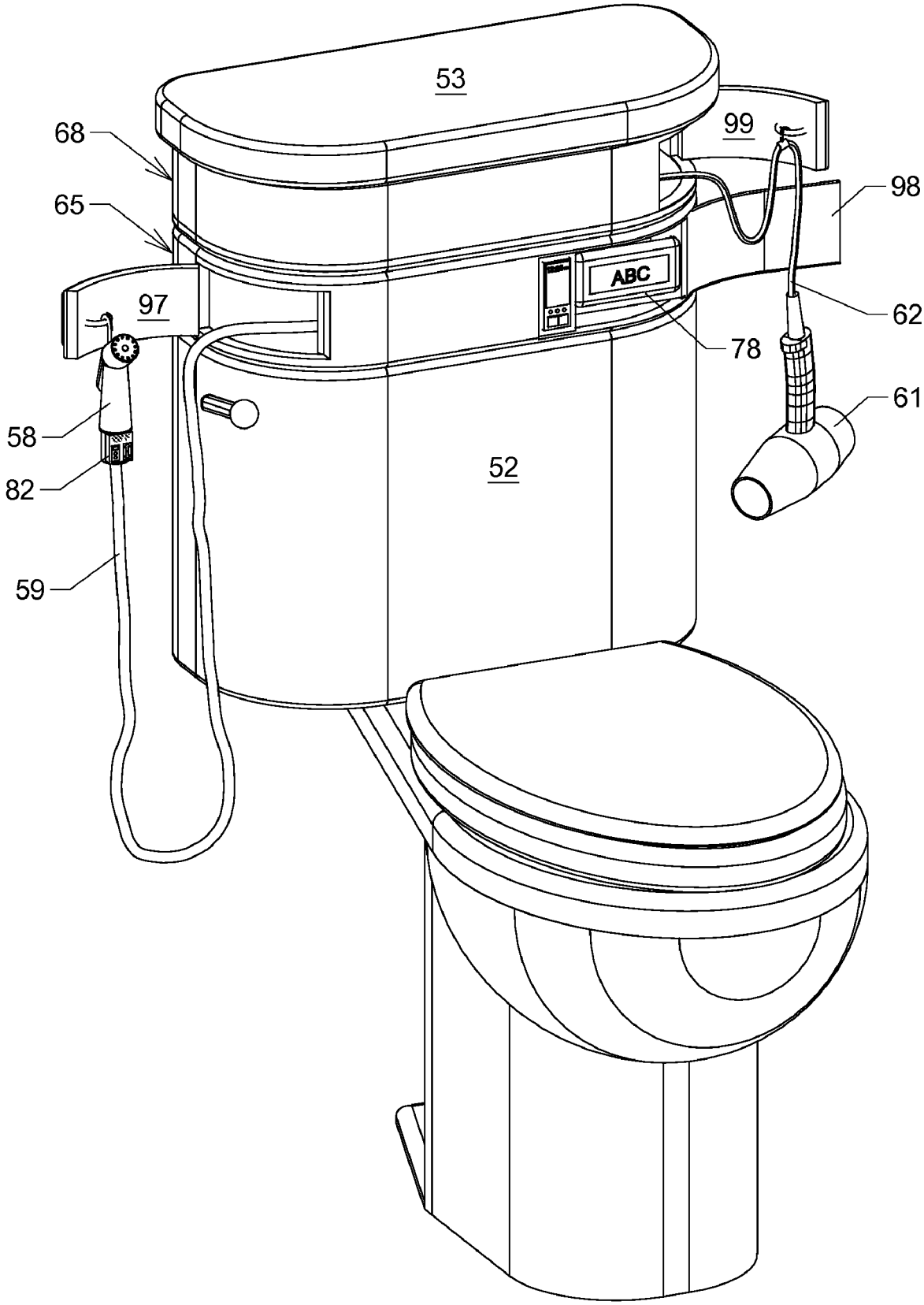
FIG. 1 shows a version of the invention that illustrates the blow-dryer assembly as installed in its own modular cabinet which is modularly stacked onto a second modular cabinet that includes bidet and cartridge based liquid dispenser assemblies.

52 Water tank
53 Lid, Water tank
54 Controller, Computer
55 Reel, Blow-dryer Rewind
56 Rim
57 Guide, Mounting
58 Sprayer, Hand-held Water
59 Hose, Water Supply
60 Reel, Water Hose Rewind
61 Blow-dryer
62 Cord, Blow-dryer Power
63 Assembly, Bidet Modular Cabinet
64 Assembly, Bidet with Cartridge Based Liquid Dispenser and Blow-dryer Modular Cabinet
65 Assembly, Bidet with Cartridge Based Liquid Dispenser Modular Cabinet
66 Assembly, Bidet with Blow-dryer Modular Cabinet
67 Assembly, Cartridge Based Liquid Dispenser Modular Cabinet
68 Assembly, Blow-dryer Modular Cabinet
69 Assembly, Water Heater and Mixing Valve
70 Inlet, Water Quick Disconnect (Male)
71 Outlet, Water Quick Disconnect (Female)
72 Line, Water Supply
73 Plug, Power
74 Receptacle, Reel Power
75 Vent, Air
76 Receptacle, Power Inlet
77 Cartridge, Disposable Liquid
78 Cartridge, Refillable Liquid
79 Cap, Refillable Cartridge
80 Label, Cartridge
81 Partition, Bidet
82 Control, Water Temperature and Computer
83 Assembly, Liquid Dispensing Pump
84 Tube, Cartridge Drain
85 Fitting, Liquid Pump Inlet
86 Tube, Liquid Pump Outlet
87 Fitting, Liquid Pump Outlet Hose
88 Fitting, Water Sprayer
89 Nozzle, Detachable Sprayer
90 Nozzle, Body Cavity
91 Heater, Water
92 Valve, Water Mixing (Cold Water)
93 Valve, Water Mixing (Hot Water)
94 Valve, Water Mixing (Cartridge)
95 Valve, Water Supply Shutoff
96 Cord, Power Supply
97 Door, Swing (Bidet)
98 Door, Swing (Cartridge)
99 Door, Swing (Blow-dryer)
100 Hose, Water Supply (to Bidet)
101 Hose, Water Supply (to Toilet Water Tank)
102 Water-T
103 Pin, Valve Actuator
104 Valve, Liquid Drain
105 Seal, O-ring
106 Sensor, Liquid Level
107 Pane, Cartridge Liquid Level Window
108 Guide, Cartridge Alignment and Support
109 Valve, Pressure Relief

DETAILED DESCRIPTION OF THE DRAWINGS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics, and features of the present invention shown in the various FIGURES are designated by the same reference numerals.

The current invention with all options consists of bidet, cartridge based liquid dispenser and blow-dryer assemblies. It incorporates a modular construction to increase its ability to be utilized in various ways thereby enhancing its usefulness to the consumer. The idea is to allow the use of any one or combination these three assemblies that are either installed into a single cabinet or installed into multiple cabinets. This modular concept is illustrated in FIG. 1 through FIG. 6, where the bidet, cartridge based liquid dispenser and blow-dryer assemblies are mounted in various modular cabinet configurations and shown as mounted on standard toilet water tanks 52.

FIG. 1 is a front perspective view of the present invention that includes a modular bidet and cartridge based liquid dispenser assembly 65 in one cabinet and a modular blow-dryer cabinet assembly 68 in a separate cabinet, both modularly stacked together on a water tank 52.

Figure 2:
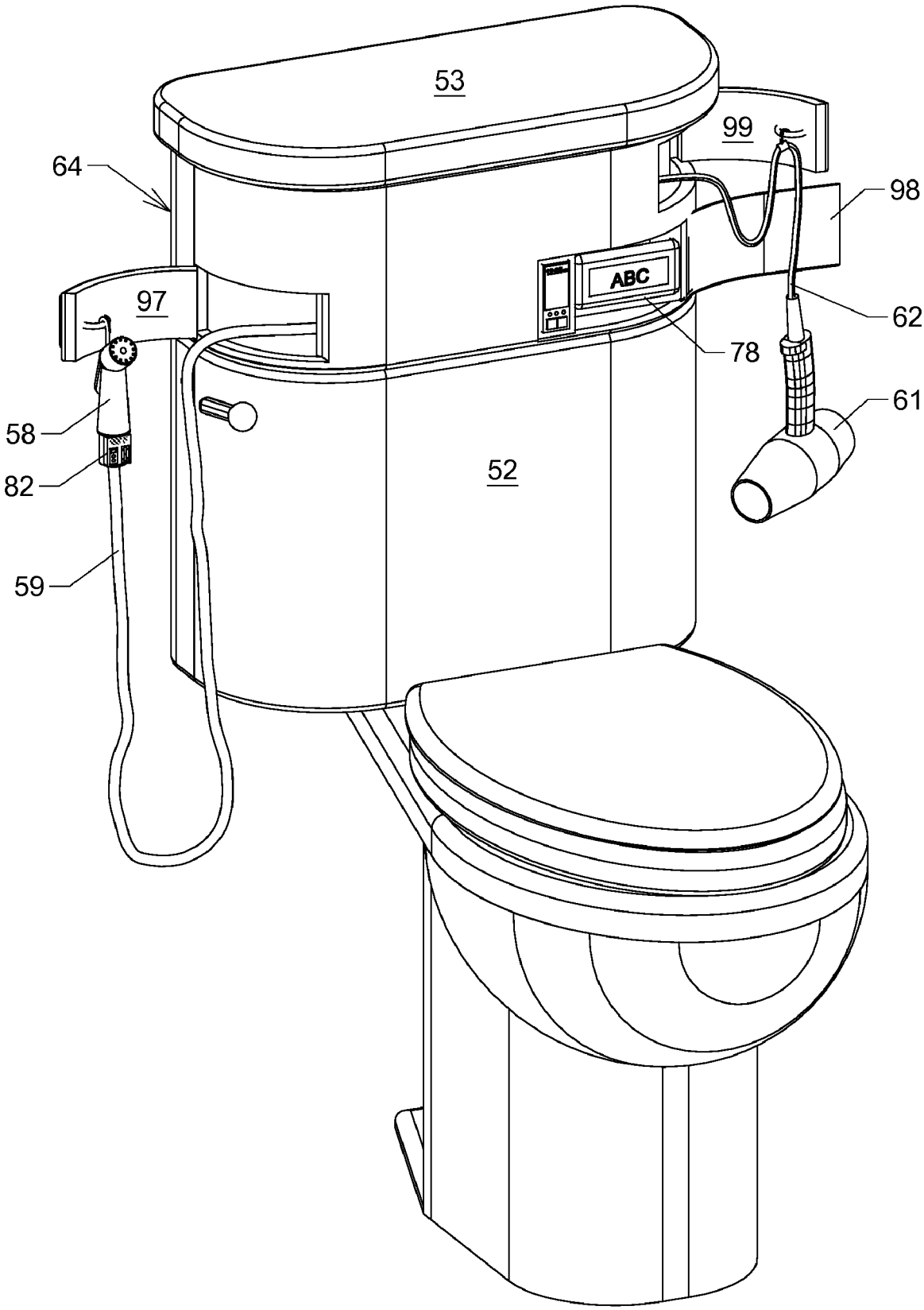
FIG. 2 is a front perspective view of bidet, cartridge based liquid dispenser and modular blow-dryer assemblies installed into a single modular chassis as mounted on a standard toilet.

FIG. 2 is a front perspective view of the present invention that includes a bidet, a cartridge based liquid dispenser and blow-dryer that are all mounted into one cabinet assembly 64.

Figure 3:
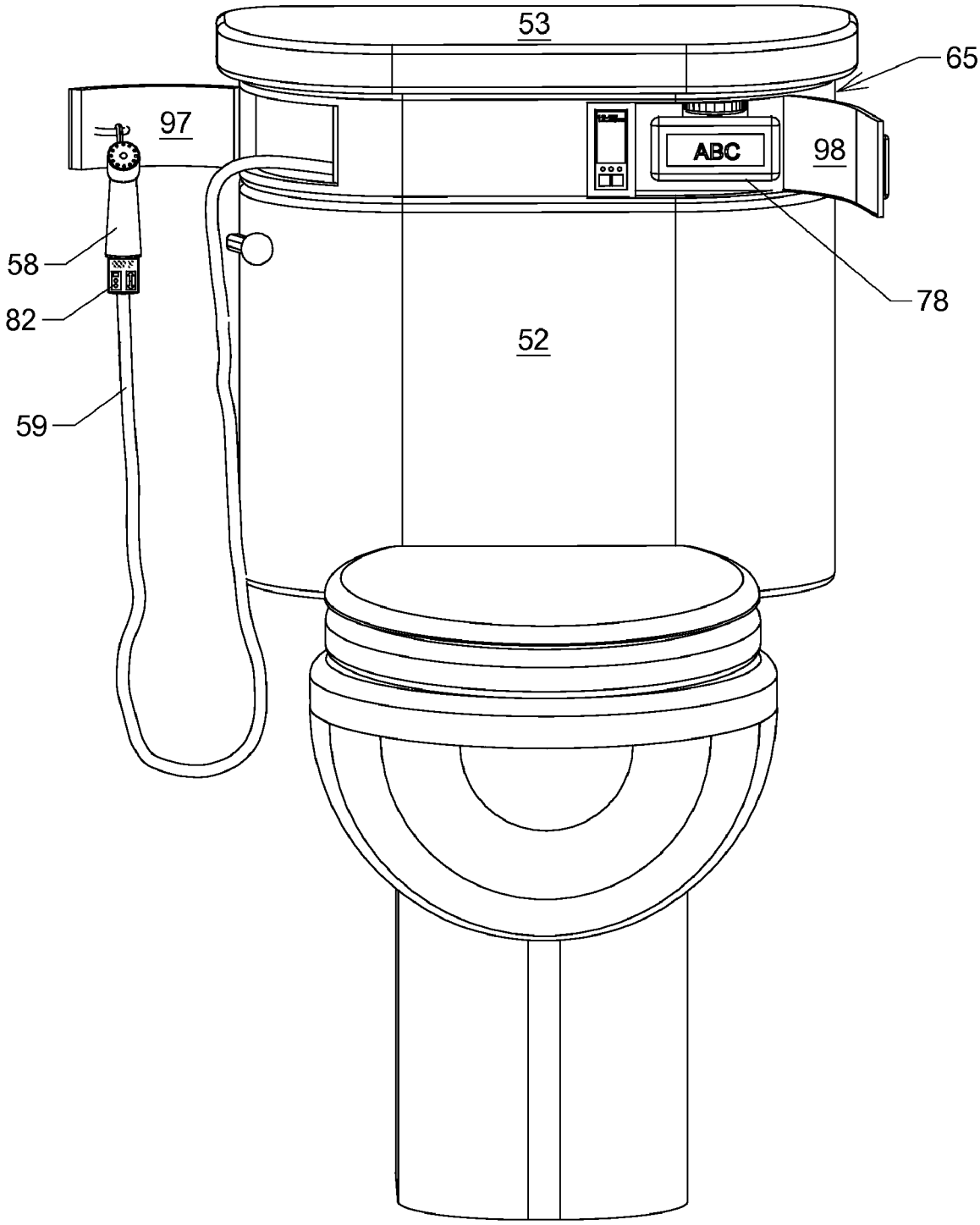
FIG. 3 is a front view of the modular bidet with a cartridge based liquid dispenser cabinet assembly as mounted on a standard toilet without the modular blow-dryer cabinet.

FIG. 3 is a front view of the modular bidet with a cartridge based liquid dispenser cabinet assembly 65 as mounted on a standard toilet with the modular blow-dryer cabinet assembly 68 omitted from the system.

Figure 4:
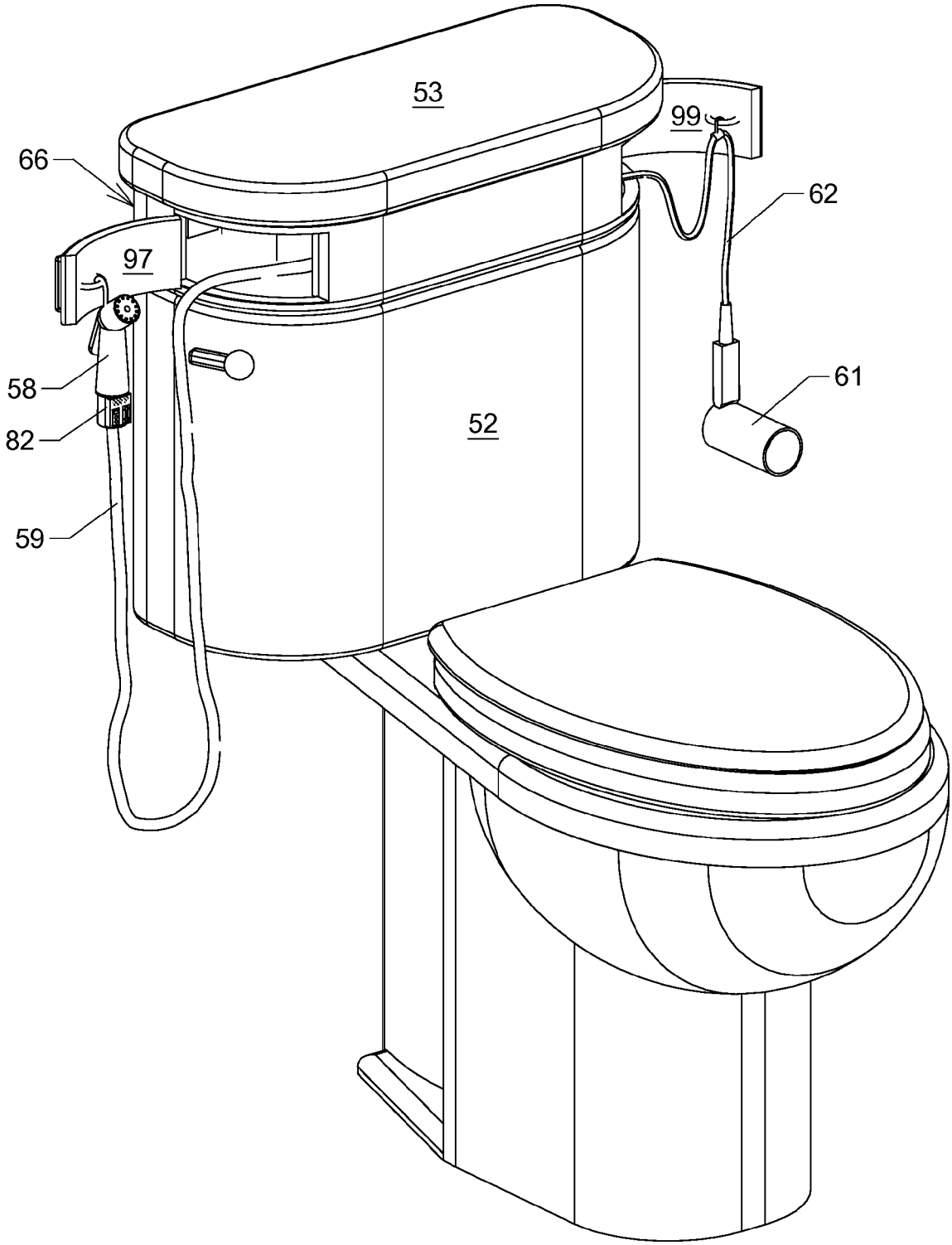
FIG. 4 is a front perspective view of another variation of the present invention where a modular cabinet is composed of only the bidet and blow-dryer assemblies.

FIG. 4 is another variation of components with only a bidet assembly and blow-dryer assembly 66 installed into one modular cabinet whereby the cartridge based liquid dispensing unit has been omitted.

Figure 5:
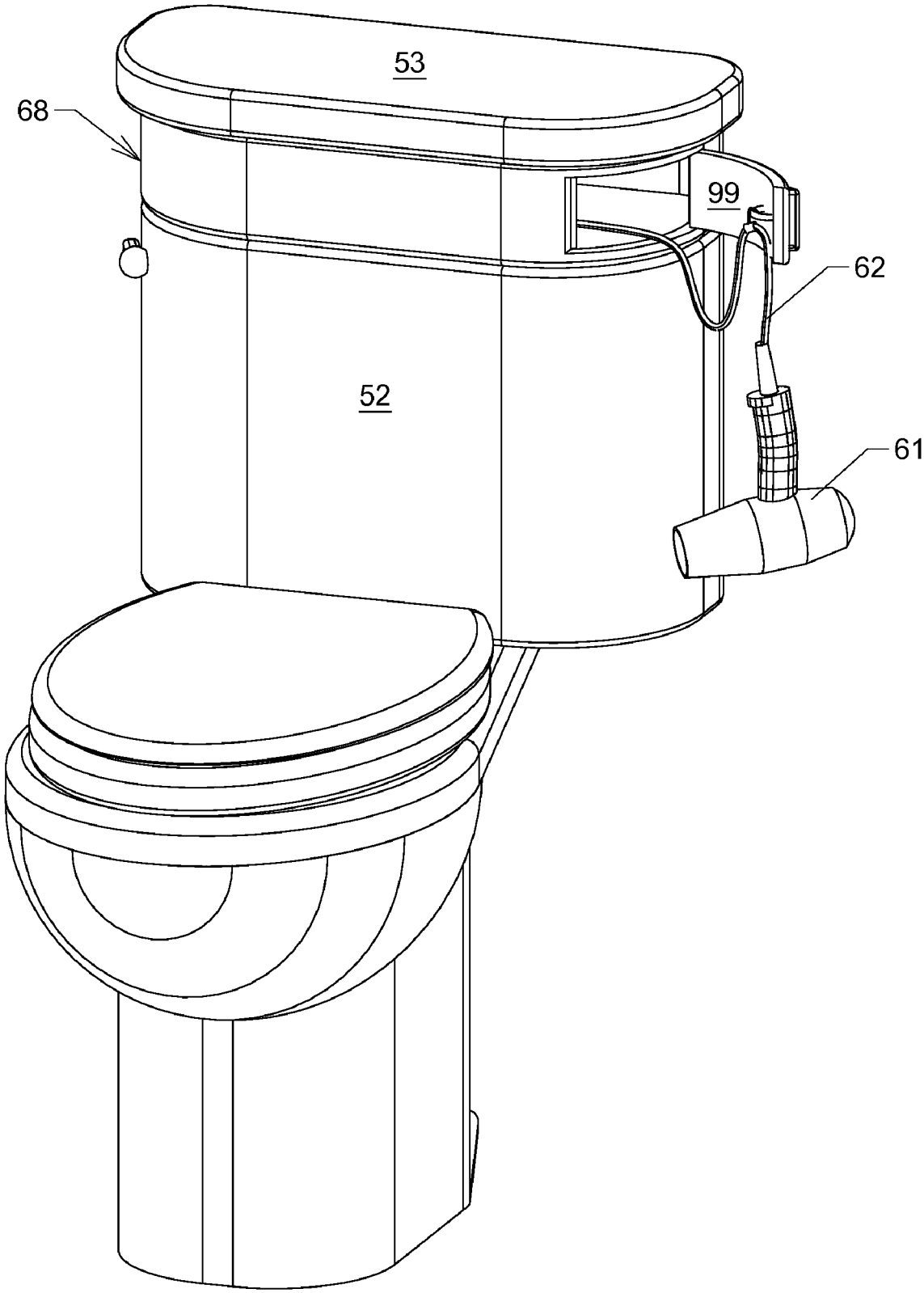
FIG. 5 is a front perspective view of the modular blow-dryer cabinet as mounted on a standard toilet.

FIG. 5 illustrates how the blow-dryer assembly 68 can be used by itself where it can be used in a general purpose way, such as drying wet hair after a shower. The blow-dryer cabinet assembly 68 then serves as a convenient place to retrieve and store a blow-dryer.

Figure 6:
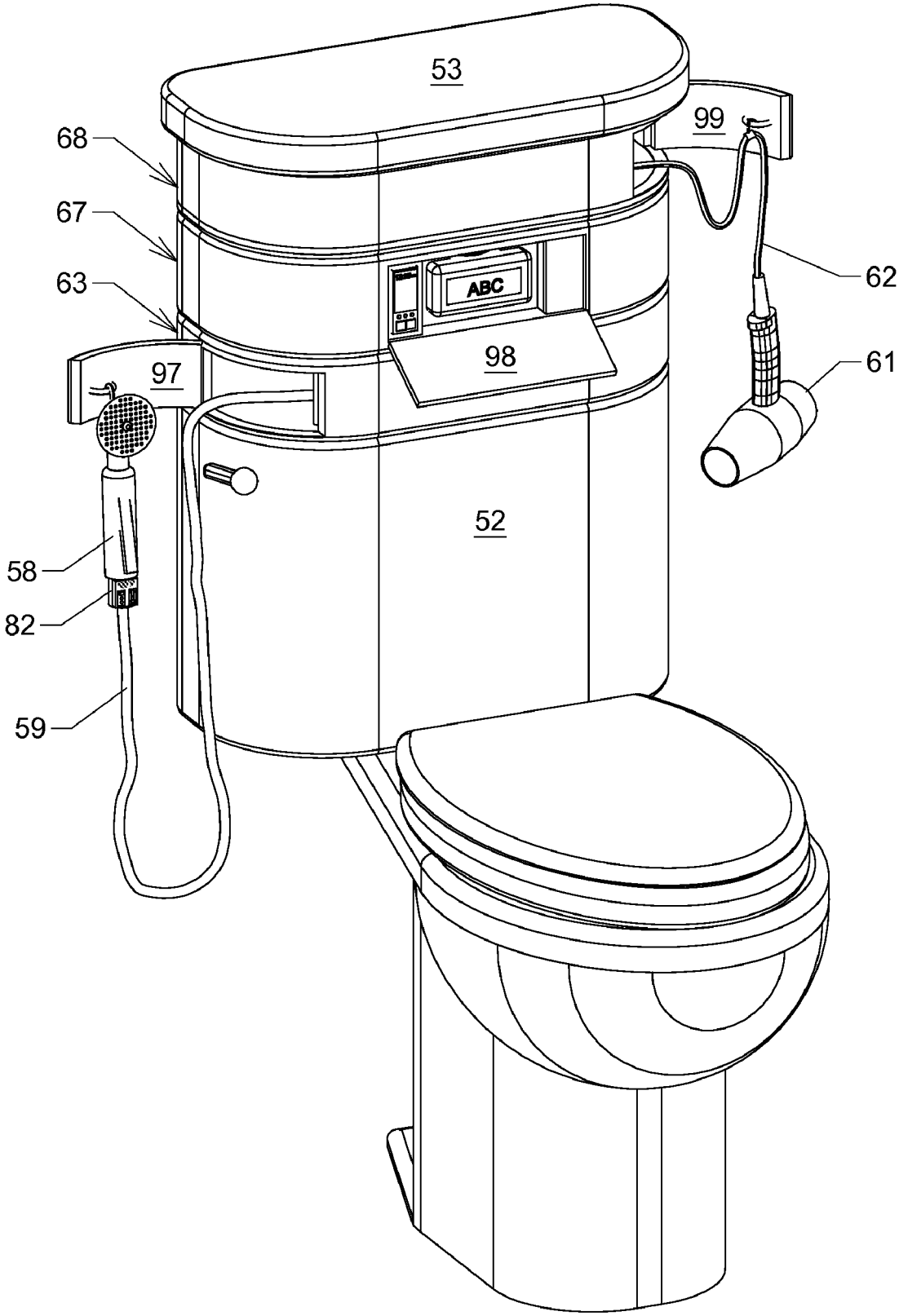
FIG. 6 is a front perspective view of yet another variation of the invention whereby each of the three components of the present invention, the bidet, the cartridge based liquid dispenser and the blow-dryer assemblies, reside in separate modular cabinets and shown mounted on a standard toilet.

FIG. 6 is a front perspective view of yet another variation of the invention whereby each of the three components of the present invention, a bidet assembly 63, a cartridge based liquid dispenser assembly 67 and a blow-dryer assembly 68, all reside in separate modular cabinets and shown mounted on a standard toilet. Each component of the system can be used in any combination together or separately.

Figure 7:
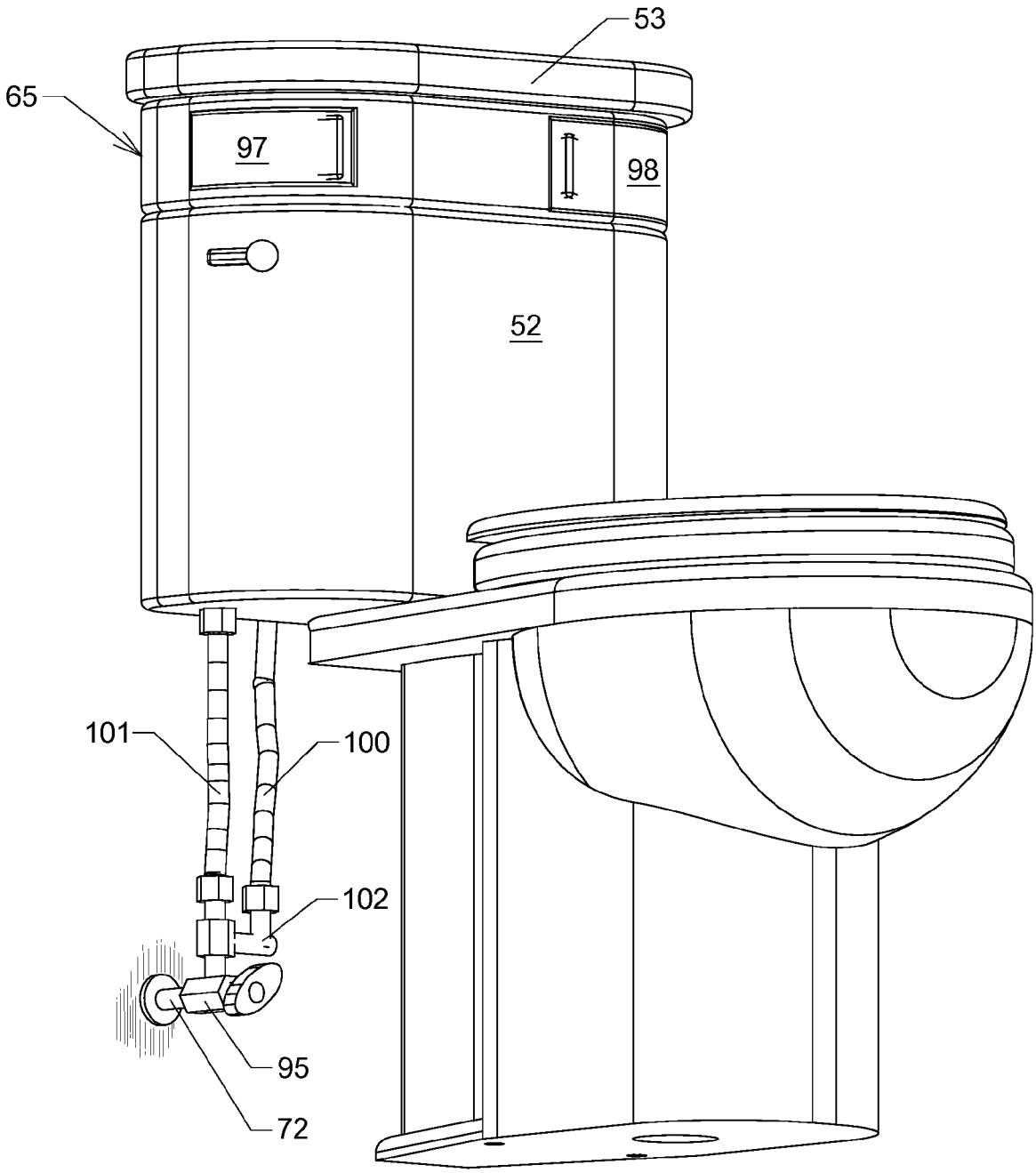
FIG. 7 is a lower front perspective view of the modular cabinet containing bidet and cartridge based liquid dispenser assemblies as mounted on a standard toilet to illustrate the water line connections.

FIG. 7 is a lower front perspective view of the modular bidet cabinet with cartridge assembly 65 as mounted on a standard toilet water tank 52 to illustrate the water line connections. The existing bathroom toilet water supply line 72 is connected to a standard water shutoff valve 95. From the outlet of this shutoff valve 95, a water-T 102 is added to tap into the toilet water tank supply line 101. Bidet water line 100 is then attached to this water-T 102 to supply water to the bidet assembly 65.

Figure 8:
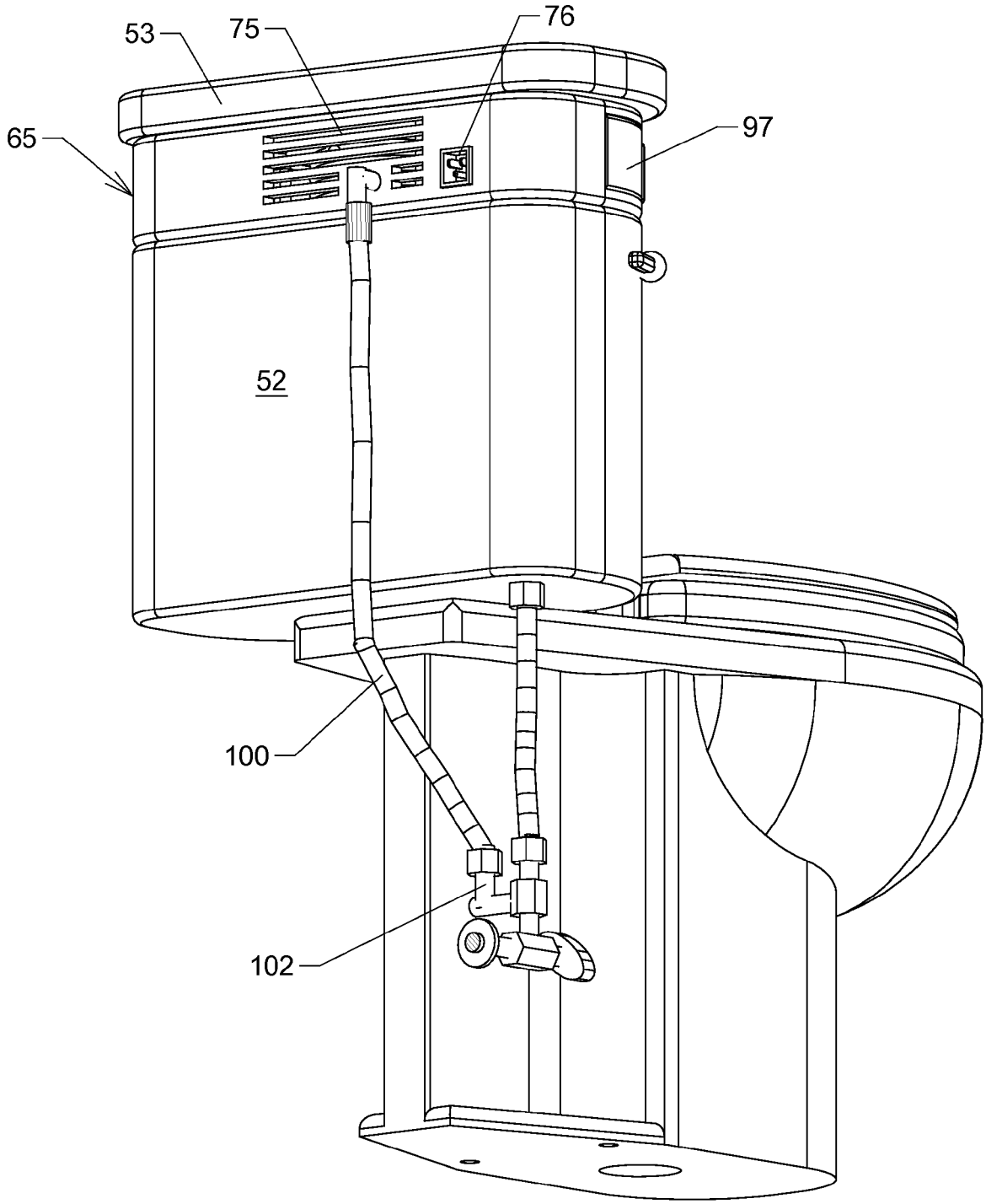
FIG. 8 is a lower rear perspective view of the modular cabinet containing bidet and cartridge based liquid dispenser assemblies as mounted on a standard toilet to illustrate the water line connections behind the toilet.

FIG. 8 is a lower rear perspective view of the modular bidet cabinet with cartridge cabinet assembly 65 as mounted on a standard toilet tank 52 to illustrate the water line connections. Bidet water supply line 100 can be seen extending from the water-T 102 to the back side of the bidet cabinet assembly 65.

Figure 9:
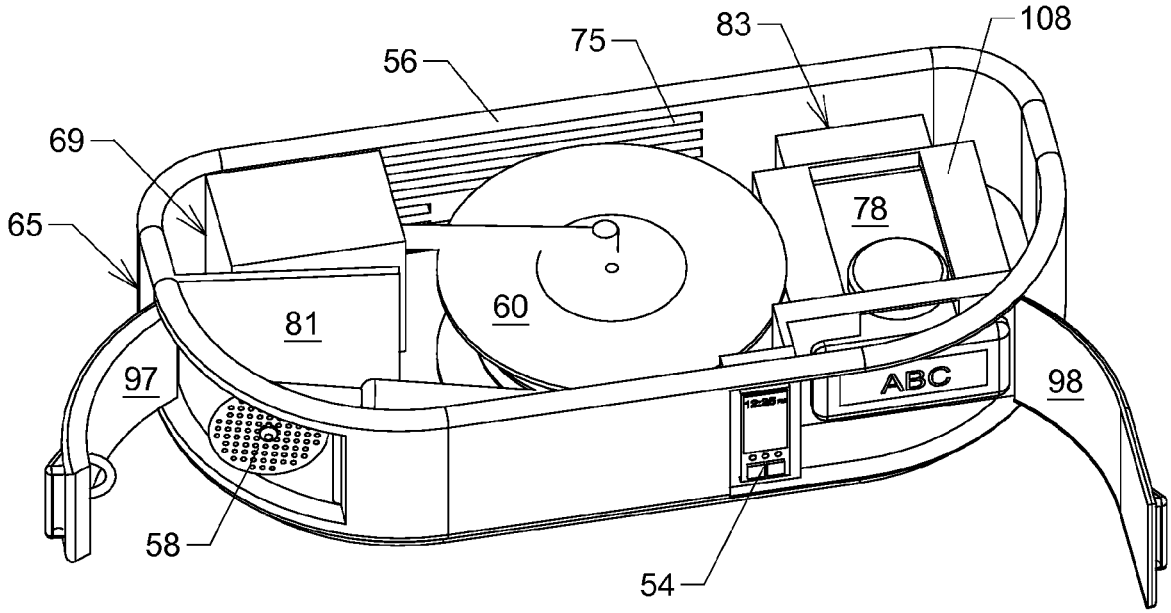
FIG. 9 is a top front perspective view of a modular cabinet containing bidet and cartridge based liquid dispenser assemblies to illustrate the components mounted inside.

FIG. 9 is a top front perspective view of the modular bidet and cartridge based liquid cabinet assembly 65 to illustrate the components mounted inside it. A water hose reel 60 is used to compactly hold the bidet water hose 59, shown in FIG. 24. The reel 60 is a tensioned device designed to uncoil the water hose once the bidet sprayer 58 is pulled on. It will automatically lock the water hose in place so that the bidet sprayer 58 can be used. A quick tug on the bidet water hose 59 would cause the hose reel 60 tensioned mechanism to automatically recoil the water hose 59 back onto the reel 60. A bidet swing door 97 is shown open to reveal a sprayer 58 inside. A simple divider 81 acts to compartmentalize the hot water and mixing valve assembly 69 from the sprayer 58. Air vents 75 in the back side of the cabinet assembly 65 is designed to allow the cabinet to breath so that any water droplets that may dribble from the end of the sprayer 58 can vent out of the cabinet 65. The bottom of the cabinet assembly 65 can also have a slightly ramped or funnel shaped bottom with a small drain tube that will allow any leaks from the sprayer 58 to drain down into the water tank 52.

FIG. 9 also shows the components of the cartridge based liquid dispenser. Door 98 is shown in an open position to reveal a refillable and replaceable cartridge 78 that is docked into the cabinet assembly 65. Electronic controller 54 is an optional controller to the bidet hose mounted controller 82, that allows the cabinet assembly 65 to dispense any desired liquid mixtures to the bidet sprayer 58. The Cartridge Alignment and Support Guide 108 keeps the cartridge 78 aligned and supported as it is inserted into the cabinet assembly 65 so that it can properly mate with the liquid pump assembly 83.

Figure 10:
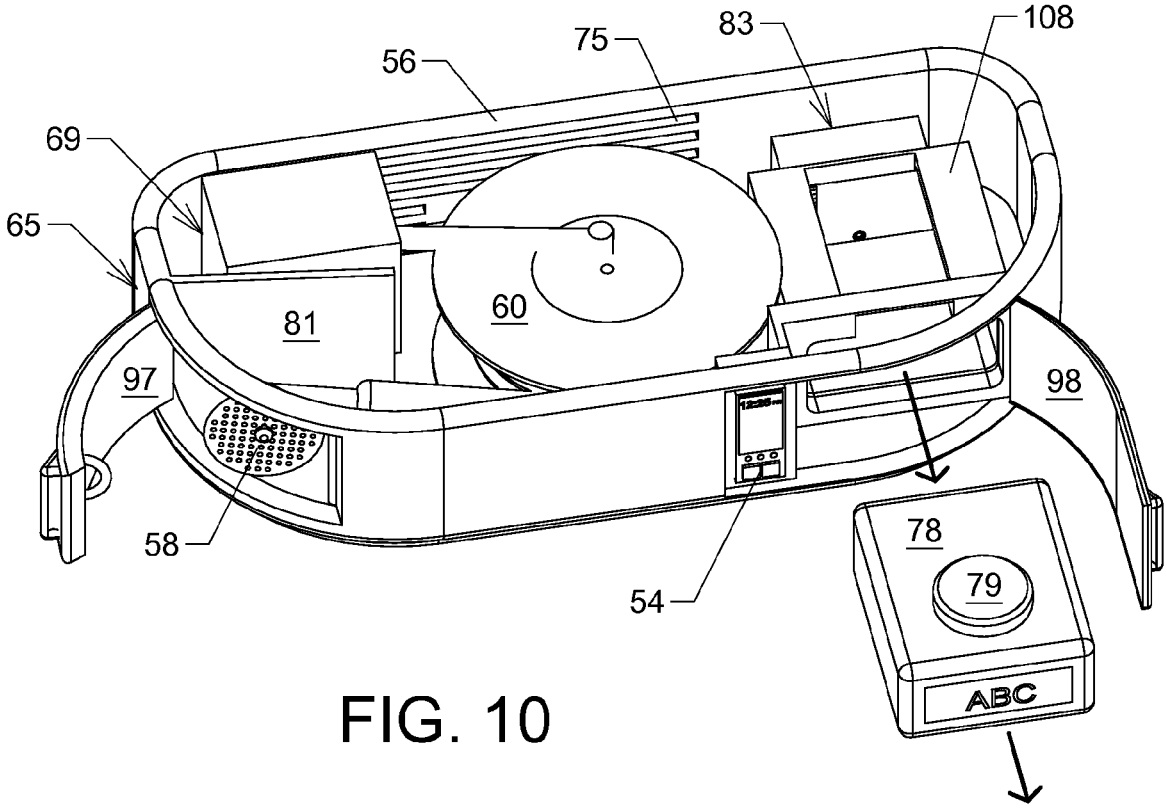
FIG. 10 is the same top front perspective view as in FIG. 9 of a modular cabinet containing bidet and cartridge based liquid dispenser assemblies but now with the cartridge removed to illustrate its removability.

FIG. 10 is the same top front perspective view of the modular bidet and cartridge based liquid cabinet assembly 65 as in FIG. 9 but shows the cartridge 78 removed to illustrate its removability. A cap 79 on the cartridge 78 is used to refill the cartridge 78. Liquid pump assembly 83 can be seen at the back end of the cabinet assembly 65, which mates with the cartridge 78 once it is inserted into the cabinet assembly 65.

Figure 14:
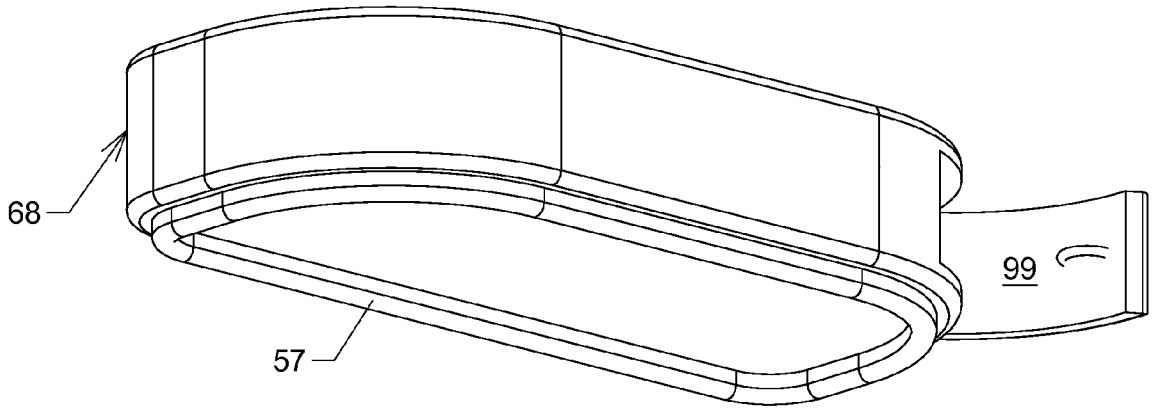
FIG. 14 is a top lower front perspective view of the modular blow-dryer cabinet to illustrate its mounting guide.

The present invention is designed to fit onto the rim of a standard water tank 52. FIG. 10 illustrates the top rim 56 where the stock water tank lid 53 can be installed or another module cabinet assembly can be stacked. FIG. 14 illustrates the modular guide 57 where it allows the modular cabinet assemblies to be secured onto the water tank or onto each other.

Figure 11:
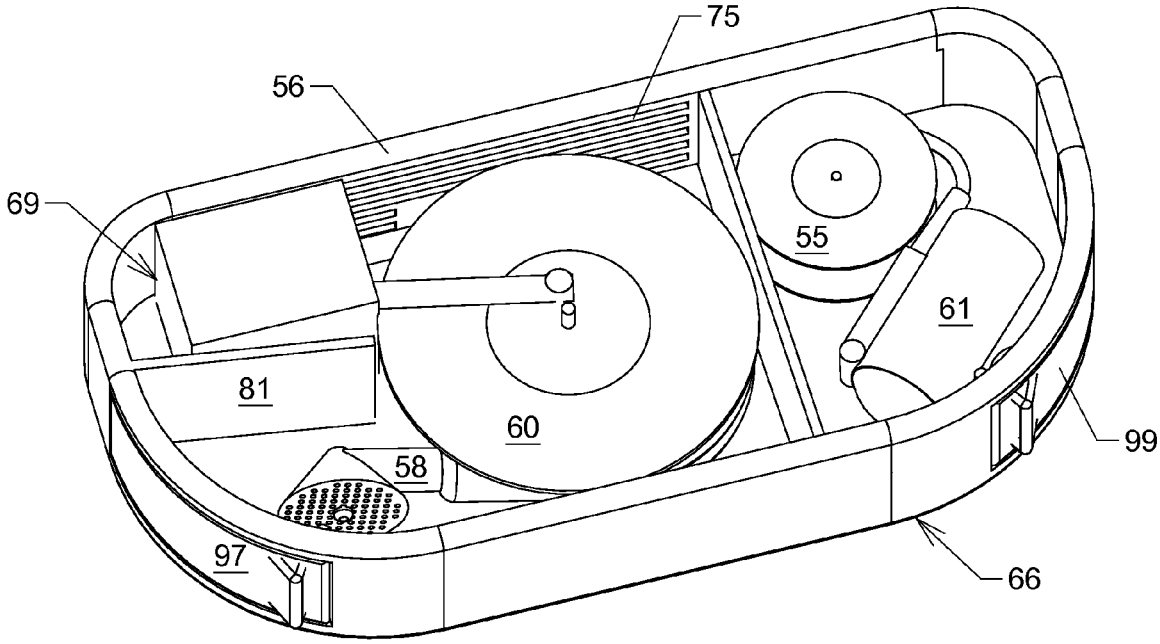
FIG. 11 is a top front perspective view of the modular cabinet containing bidet and blow-dryer assemblies to illustrate the components mounted inside.

FIG. 11 is a top front perspective view of the modular bidet and blow-dryer cabinet assembly 66 to illustrate the components mounted inside. A compact blow-dryer 61 can be seen inside the cabinet assembly 66 next to its cord rewind reel 55.

Figure 12:
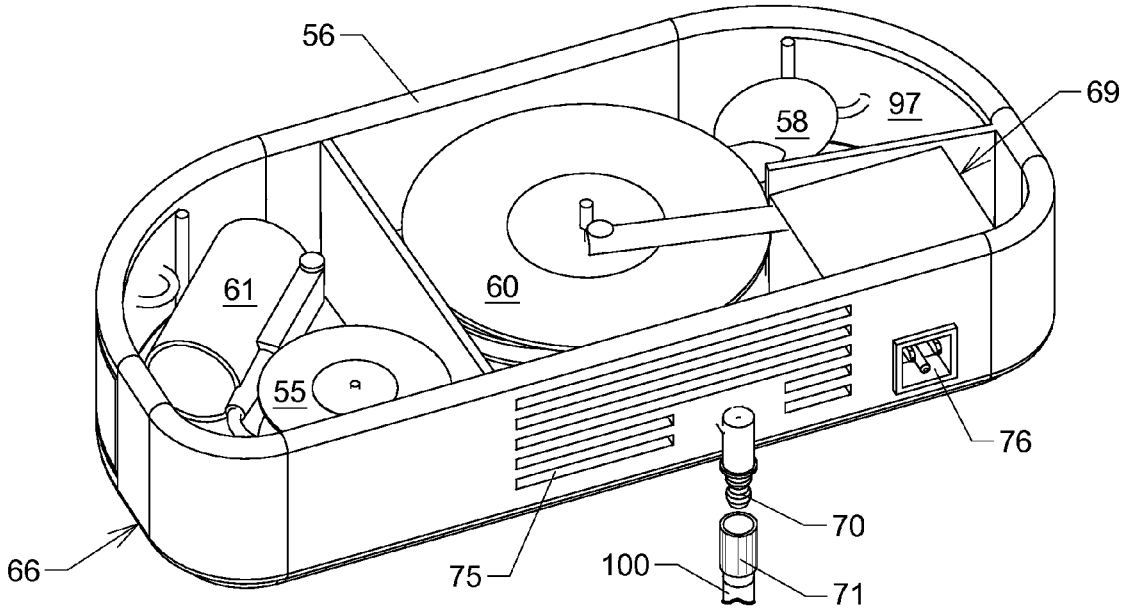
FIG. 12 is a top rear perspective view of the modular cabinet containing bidet and blow-dryer assemblies to illustrate the components mounted inside and to show the back cabinet panel detail that includes a view of a quick-disconnection for the water supply line inlet.

FIG. 12 is a top rear perspective view of the modular bidet and blow-dryer cabinet assembly 66 to illustrate the components mounted inside and the back cabinet panel detail. The bidet water supply hose 100 is shown with a female quick-disconnect 71 that mates with a male quick-disconnect 70 so that the bidet water supply line 100 can be quickly disconnected from the bidet and blow-dryer cabinet assembly 66. This would allow for the quick removal of the modular bidet cabinet assembly 66 so that the internal components of the toilet tank 52 can be made, such as freeing up a stuck toilet tank flush valve. A valve inside the female quick-disconnect fitting 71 would prevent the water flow in the event the male quick-disconnect 71 fitting is removed from it. Cold water is then supplied from the quick-disconnect fitting 70, to the hot water and mixing valve assembly 69. This assembly 69 is made up of industry standard components, designed to heat and then mix the heated water with the cold water supply. A standard male power receptacle 76 allows for a standard female power cord to be attached to a household receptacle.

Figure 13:
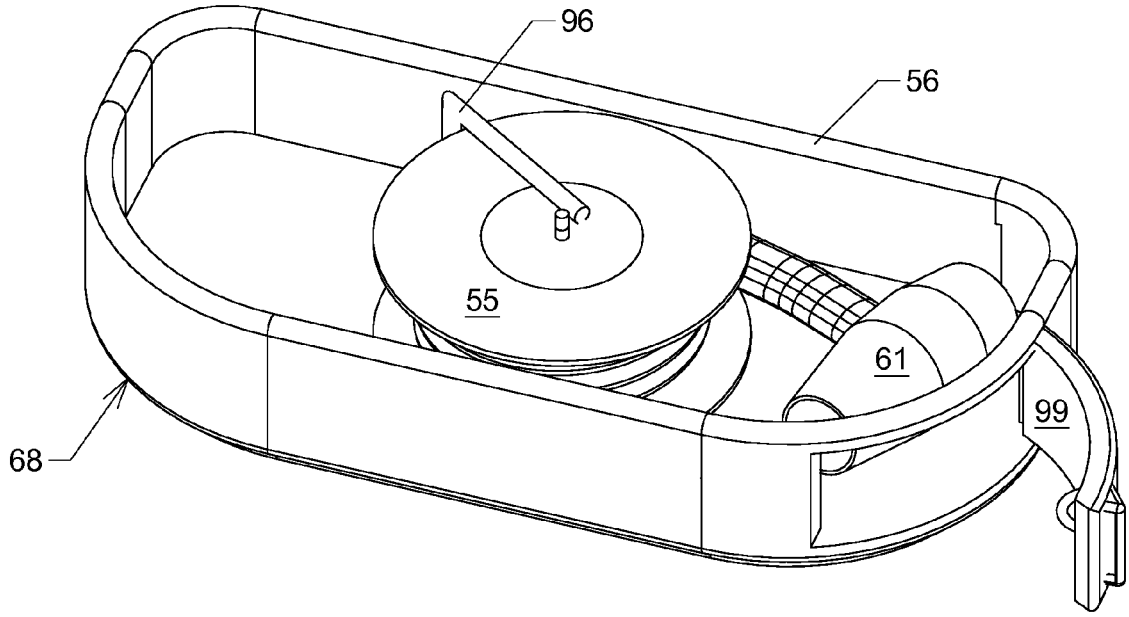
FIG. 13 is a top front perspective view of the modular blow-dryer cabinet to illustrate the components mounted inside.

FIG. 13 is a top front perspective view of the modular blow-dryer cabinet assembly 68 to illustrate the components mounted inside it. This full sized cabinet allows for larger blow-dryers 61 to be utilized.

FIG. 14 illustrates the modular guide 57 where it allows the modular cabinet assemblies to be secured onto the water tank or onto each other. This guide 57 can be made to be adjustable so that a single cabinet shape can be made to fit a wide variety of tanks 52.

Figure 15:
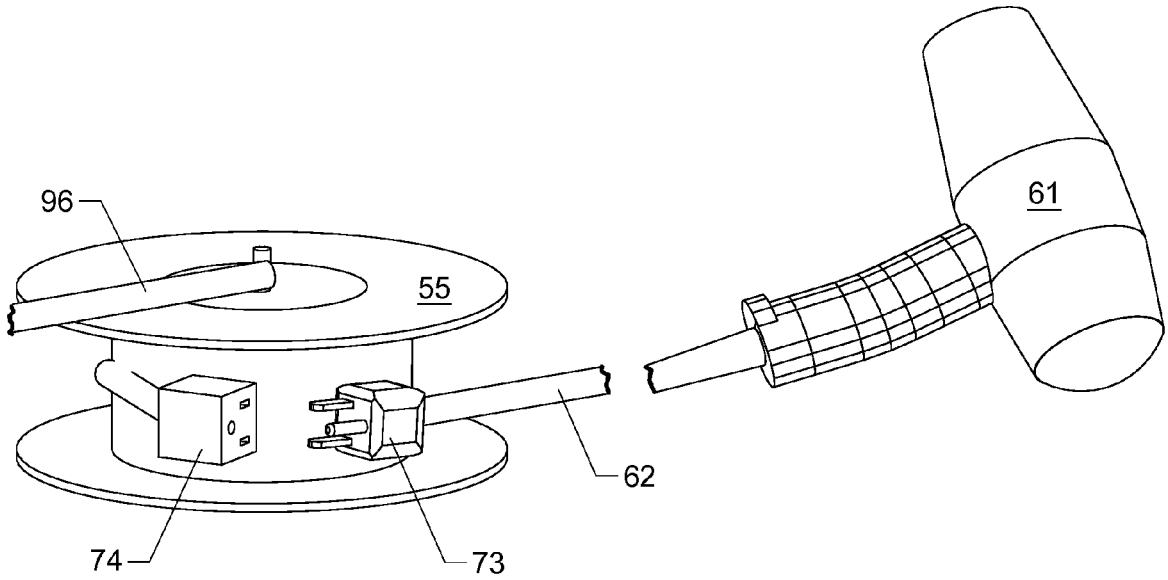
FIG. 15 is a top perspective view of the blow-dryer reel to illustrate the receptacle connection on the reel to allow a standard blow-dryer's cord to be plugged into it.

FIG. 15 illustrates a power receptacle 74 that is mounted in the cord reel 55. This will allow a blow-dryer's power plug 73 to be connected to it. The blow-dryer's cord 62 can then be wound around it. This feature will allow just about any standard type of blow-dryer 61 to be utilized.

Figure 16:
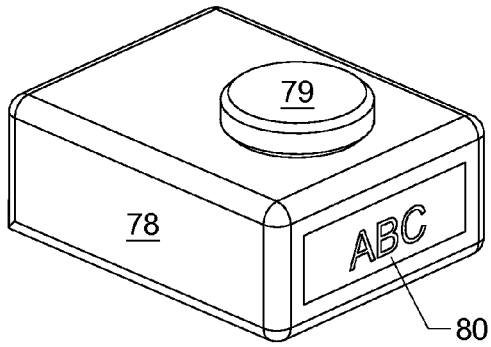
FIG. 16 is a front perspective view of a refillable version of the liquid cartridge that utilizes a ventilated refill cap, and shows a label affixed to the front side.

FIG. 16 is a front perspective view of a replaceable and refillable cartridge 78 shown with its refill cap 79. The refill cap 79 is ventilated, which allows a one-way flow of air into the cartridge 78 as its solution is consumed. The refillable cartridge 78 can be removed at any time, where a spring loaded drain valve 104 located inside its drain tube 84 closes whenever it is pulled away from the pump assembly 83, shown in FIG. 19. The refill cap 79 can be removed and more solution added. A cartridge label 80 can be used to identify the contents of the refillable cartridge 78.

Figure 17:
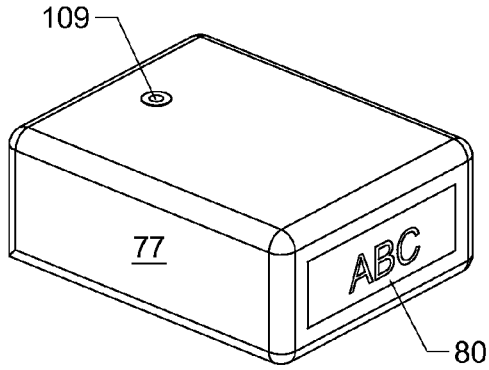
FIG. 17 is a front perspective view of the disposable version of the liquid cartridge with a pressure relief valve located on its top side, and shows a label affixed to the front side.
Figure 19:
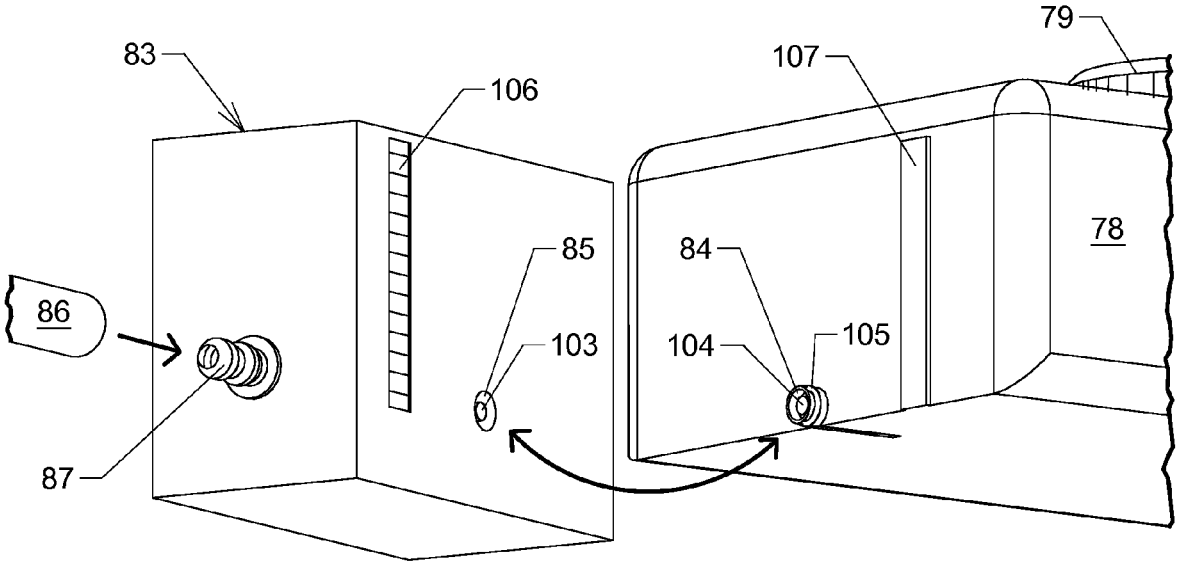
FIG. 19 is a lower front perspective view of a liquid cartridge and liquid pump assembly with the liquid pump assembly slightly cocked from the normal alignment with the cartridge to illustrate the orientation of the mating orifices that communicate the liquid from the cartridge to the pump assembly. This view also shows the liquid level sensor on the pump assembly and its mating window pane on the cartridge.

FIG. 17 is a front perspective view of a disposable liquid cartridge 77. This disposable cartridge 77 has no refill cap 79 since it is meant to be disposable. However, a refillable cartridge 78 could also be disposable. FIG. 17 also shows a pressure relief valve 109 which allows a one-way flow of air into the cartridge 77 as its solution is consumed. The disposable cartridge 77 can be removed at any time, where a spring loaded drain valve 104 located inside its drain tube 84 closes whenever it is pulled away from the pump assembly 83, as depicted in FIG. 19. Cartridges with various liquid types can be made available that allows a user to simply install the cartridge from its wrapper into the cabinet. Once the cartridge's content is consumed, the cartridge 77 can be conveniently disposed. A cartridge label 80 can be used to identify the contents of the disposable cartridge 77.

Figure 18:
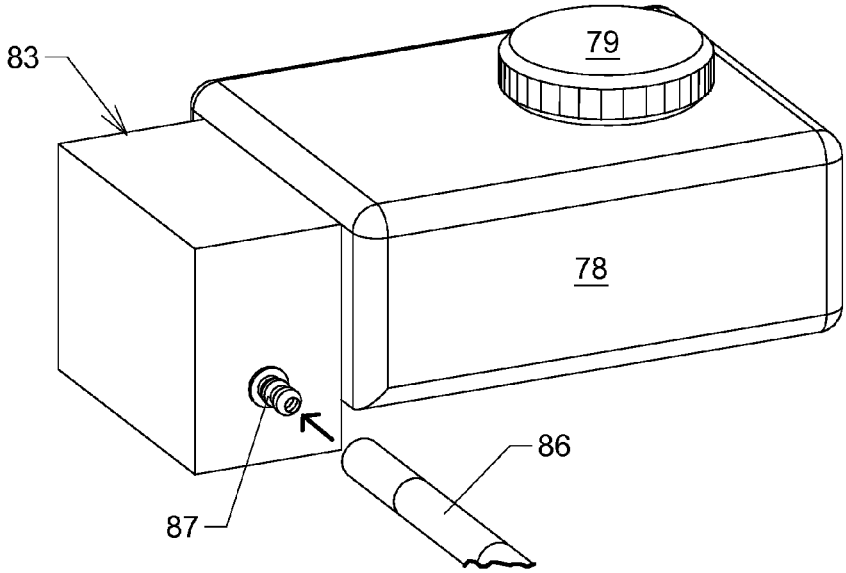
FIG. 18 is a top rear perspective view of a cartridge and liquid pump assembly to show how they would normally be mated together inside the cabinet.
Figure 24:
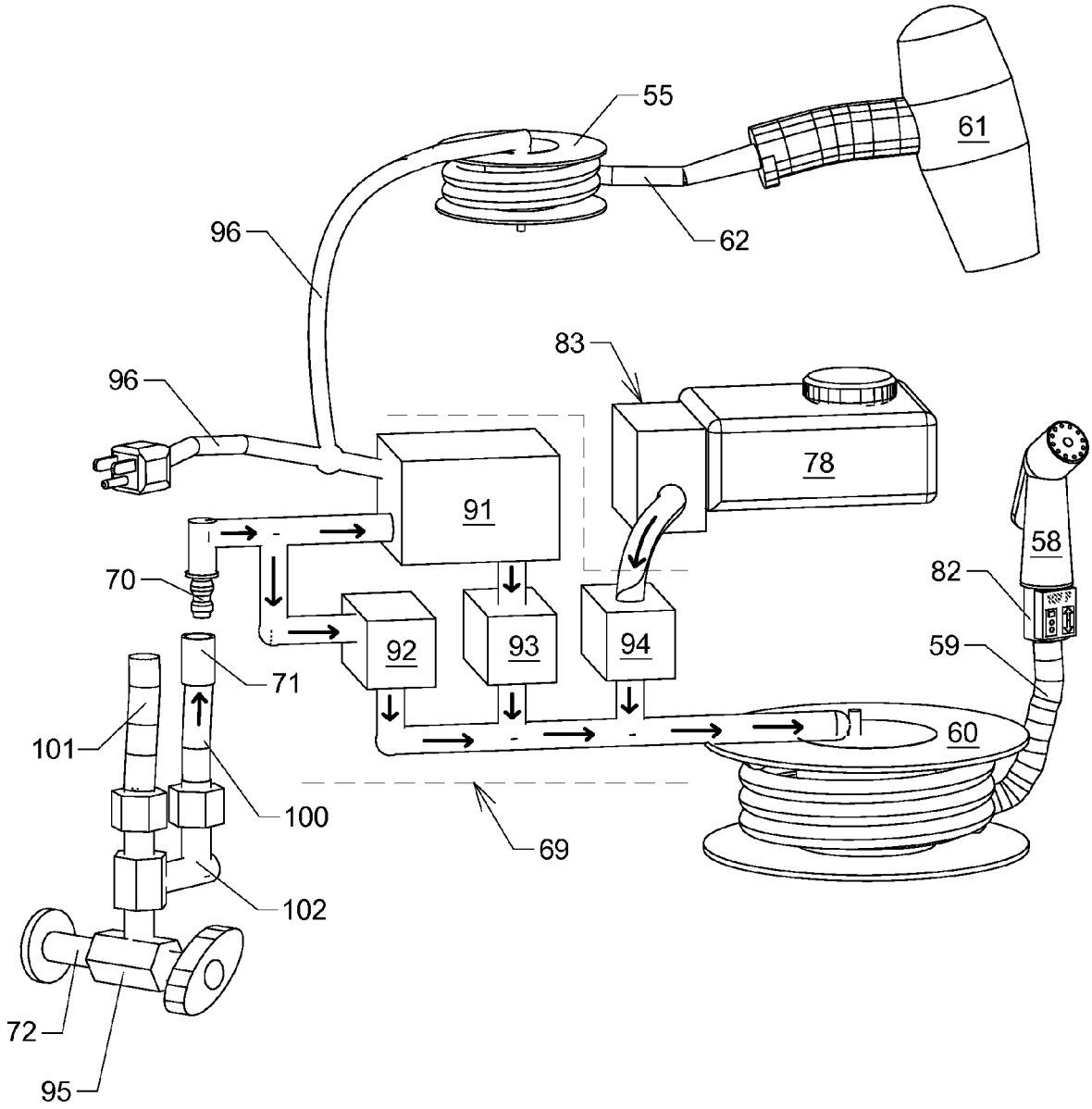
FIG. 24 is a diagram to illustrate the general construction of the hot water and mixing valve assembly and its function in the bidet and cartridge based liquid system.

FIG. 18 is a rear perspective view of the cartridge 78 and liquid pump assembly 83 to illustrate how the cartridge 78 mates with liquid pump assembly 83. A tube 86 is attached to the liquid pump outlet fitting 87 to communicate the liquid from the cartridge 78 to the bidet mixing valve 94, as shown in FIG. 24.

FIG. 19 is a rear lower perspective view of the liquid pump assembly 83 as slightly cocked from its normal alignment with the cartridge 78 to illustrate the mating of the cartridge drain tube 84 with the liquid pump inlet fitting 85 that conveys the liquid from the cartridge 78 into the pump assembly 83. Once the cartridge 78 is completely inserted into the cabinet assembly 64, its drain tube 84 becomes mated with liquid pump inlet fitting 85. An O-ring style seal 105 is used around the outside circumference of the drain tube 84 so that it can seal with the inlet fitting 85. A stationary valve actuator pin 103 inside the pump inlet fitting 85 pushes against the liquid drain valve 104 inside the cartridge drain tube 84, causing it to open and allows the liquid inside cartridge 78 to flow into the pump inlet fitting 85. Once the pump assembly 83 is activated, liquid is drawn out of the cartridge 78 and is discharged through a liquid pump discharge fitting 87 where a flexible liquid discharge tube 86 then directs the liquid to the cartridge liquid mixing valve 94, shown in FIG. 24.

FIG. 19 also shows an electronic liquid level sensor 106 on the pump assembly 83 and a liquid level window pane 107 on the cartridge 78. The pane 107 normally rests within very close proximity to the level sensor 106. The window pane 107 portion of the cartridge 78 is made of a transparent material so that the sensor 106 can detect the level of the fluid inside the cartridge 78. The level sensor 106 communicates with the control module 54 so that the fluid level can be known and displayed. The control module 54 could flash a lamp or provide a periodic audible beep to signal a low fluid level condition.

Figure 20:
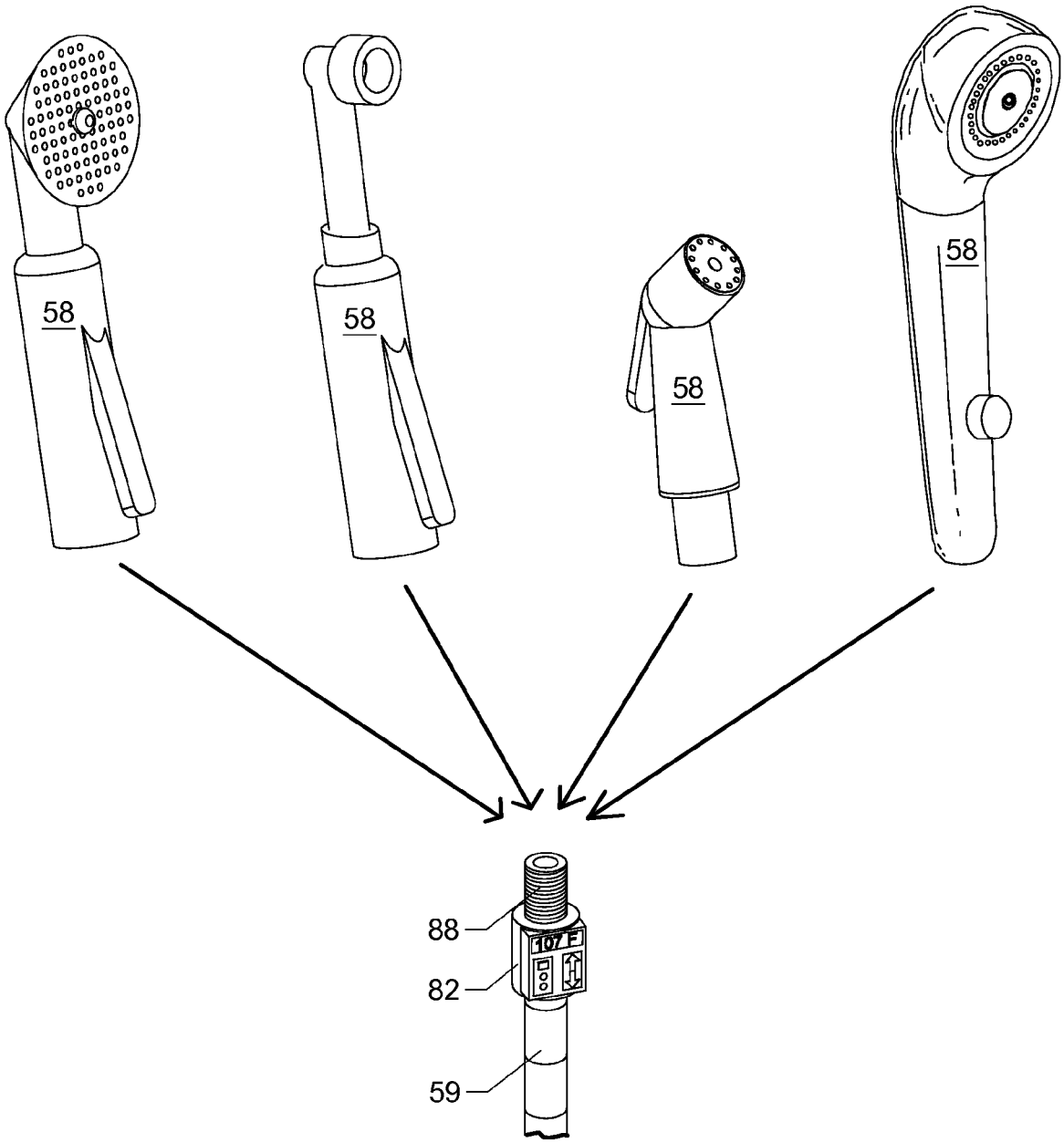
FIG. 20 is an illustration of how the bidet water hose end can accommodate a wide variety of standard design water sprayers.

FIG. 20 is an illustration of how a variety of standard design of replaceable water sprayers 58 can be installed onto the bidet water hose sprayer fitting 88. This feature allow for user customization so that any desired sprayer can be utilized.

Figure 21:
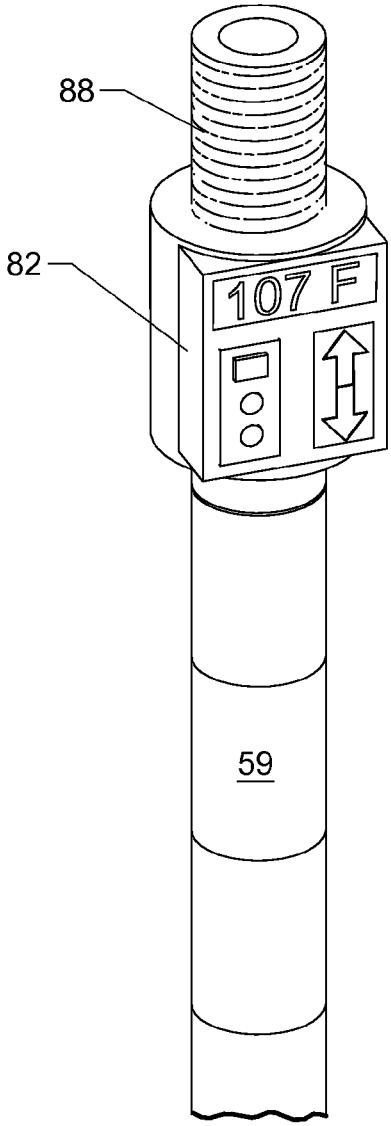
FIG. 21 illustrates a view of the water temperature control unit that is mounted on the end of the bidet water hose.

FIG. 21 illustrates a view of the water temperature and computer controller 82 that is mounted on the end of the bidet water supply hose 59. This electronic device contains a water temperature probe, a digital readout of the sprayer water temperature, switches and electronic circuits to control the water mixing valves 92, 93 and 94, shown in FIG. 24. A water temperature probe not only measures the temperature of the water for display to the user, but also allows feedback to the water temperature and computer controller 82 so that a constant water temperature output can be maintained. Electrical conductors are embedded inside the jacket of the bidet hose 59 that provides low voltage power to the device as well as provides control lines to the mixing valves. A user can simply pick a desired water temperature, and the controller 82 will then control the water mixing valves 92 and 93 to deliver the desired water temp, shown in FIG. 24. This device also allows the user to control the liquid cartridge mixing valve 94. This allows a user to dispense the liquid from the cartridge 78 into the bidet sprayer at a desired measured amount. The user can allow the liquid to be mixed in with warm water for a perfect temperate spray, or can simply switch the mixing valves so that an undiluted liquid is dispensed to the sprayer 58.

Figure 22:
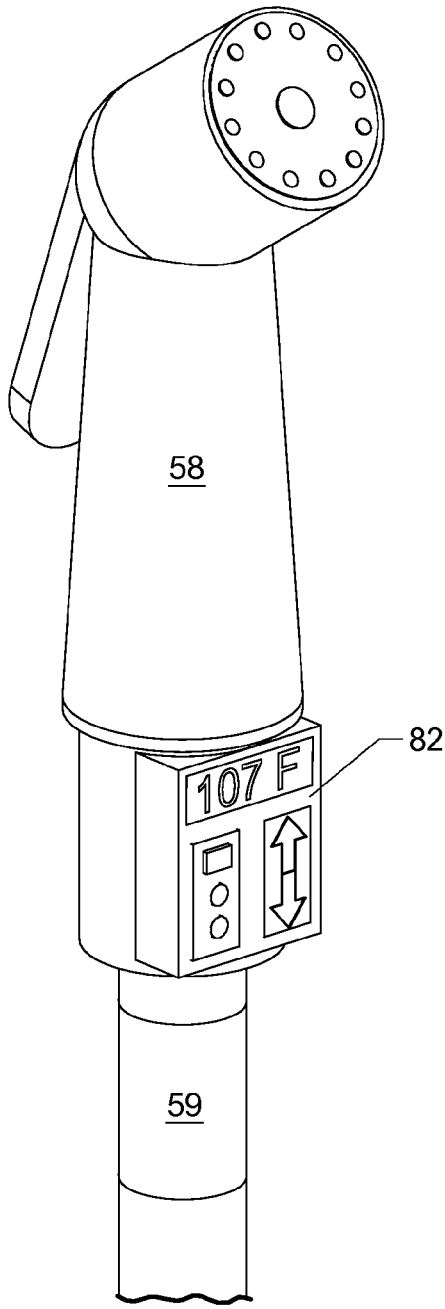
FIG. 22 illustrates the bidet water hose with temperature control unit with a replaceable water sprayer mounted onto it.

FIG. 22 illustrates the bidet water hose 59 with temperature and computer controller 82 with a water sprayer 58 mounted onto it.

Figure 23:
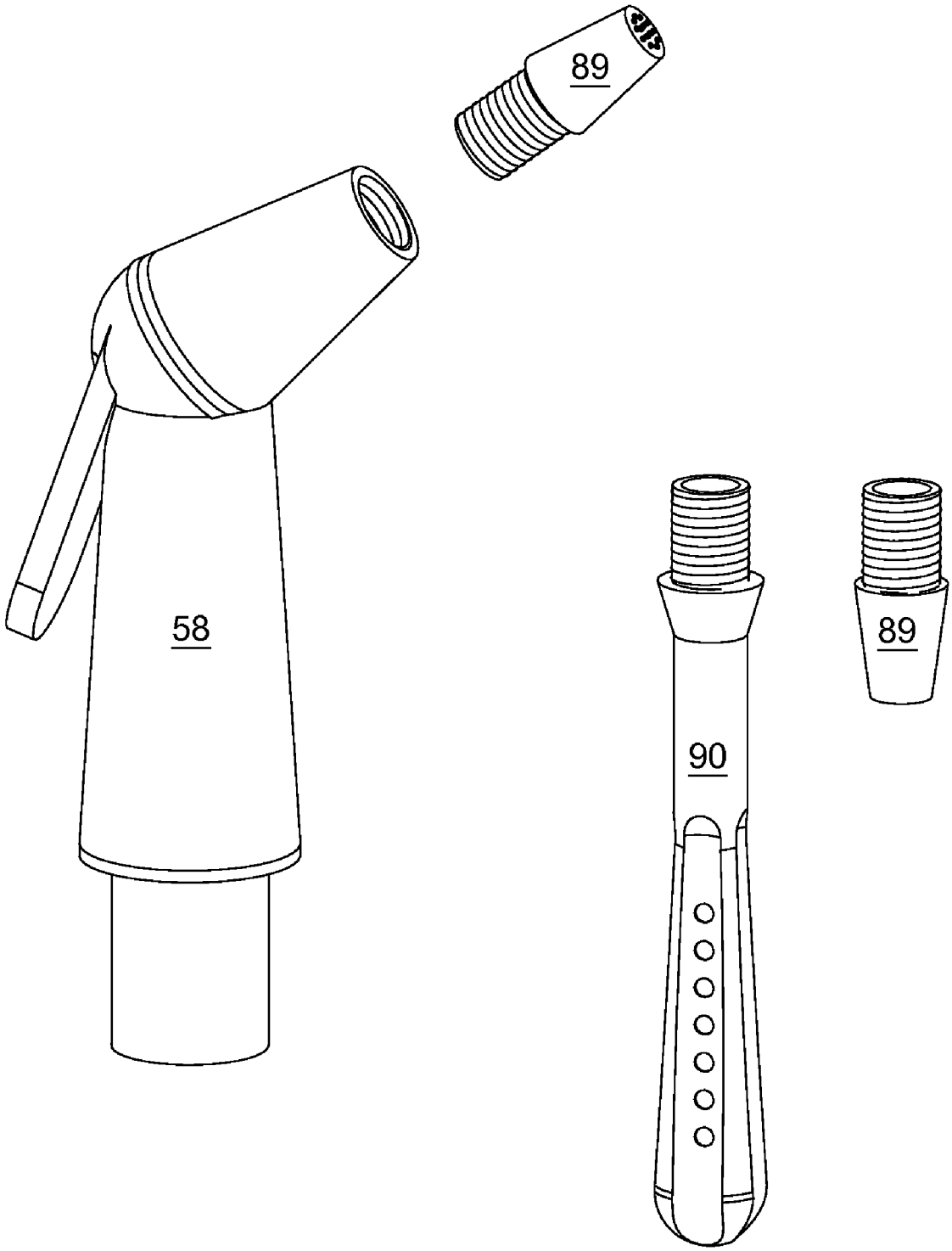
FIG. 23 illustrates a water sprayer with a removable nozzle and shows a standard spray nozzle along with an optional body cavity nozzle.

FIG. 23 illustrates a water sprayer 58 with a nozzle 89 to demonstrate its removability and shows a standard nozzle 89 compared with an optional body cavity nozzle 90. This cavity nozzle 90 can be disposable. This demonstrates how the bidet sprayer 58 can be used for the hygienic rinsing of body cavities.

FIG. 24 is a diagram to illustrate the general construction of the current invention. Water flows under pressure from the bathroom cold water supply line 72 into a shut-off valve 95. The water then flows through a water-T 102 connection whereby it communicates with a female quick-disconnect 71. This female quick-disconnect is coupled with a male quick-disconnect 70 which then provides the internal components of the cabinet with pressurized cold water. A dashed line is shown around the water heater and mixing valves assembly 69 to illustrate the components inside. The water supply hose 100 supplies water to a water heater 91 and to a cold water mixing valve 92. A hot water mixing valve 93 is attached to the output of the water heater 91. The output from the cold water valve 92 and hot water mixing valve 93 are fluidly connected together to allow precise mixing of the hot and cold water to achieve any desired water output temperature to the water sprayer 58. An electronic controller 82 that contains a temperature water probe provides feedback and control to the mixing valves to provide a constant water temperature at the sprayer 58. The mixed water supply then flows to a water hose reel 60, which is a standard device to allow the water hose to be uncoiled and automatically recoiled back onto it. A bidet water hose 59 is connected to the reel 60 and is normally coiled around said reel 60. The electronic controller 82 can be seen mounted on the end of the bidet water hose 59, where the bidet water sprayer 58 is connected onto it.

FIG. 24 also illustrates the connections of the cartridge based liquid dispenser apparatus and shows how the system can introduce a liquid into the bidet sprayer water stream. It consists of a refillable cartridge 78, a pumping unit 83, a liquid mixing valve 94 and electronic controller 82. Note that the pumping unit 83 and mixing valve 94 could be build together as a single device, but is shown here as separate units for clarity. The pump assembly 83 sucks liquid from the bottom back end of the cartridge 78 and then pumps it under pressure to the mixing valve 94. The electronic controller 82 allows full control over all three mixing valves, from full off to full to control the water temperature and amount of liquid flow from the cartridge 78 into the bidet sprayer 58. This allows the user to dispense a diluted liquid from the cartridge 78 whereby it is mixed with a warm water supply from the cold water mixing valve 92 and hot water mixing valve 93. It can also be dispensed full strength, whereby only the solution from the cartridge 78 is pumped to the bidet sprayer 58.

FIG. 24 also illustrates the third element of the invention, which is makes use of a commonly available hand-held hot-air hair blow-dryer 61. A commonly available cord reel 55 is used which is a standard device to allow the blow-dryer's electrical cord 62 to be uncoiled and automatically recoiled back onto it. The cord reel 55 is connected to a power supply line 96 to supply household power to the blow-dryer 61.

What is claimed is:

1. A bidet system that is designed to be installed onto a toilet water tank, comprising:

a) a cabinet having a top side with a rimmed edge and bottom side with a mounting guide and defining at least one interior compartment, comprising:
- i) said top side rimmed edge that is shaped to allow the original toilet tank lid to be installed securely upon it;
- ii) said cabinet mounting guide that protrudes from said bottom side of said cabinet that is shaped to engage the rim of a toilet tank for the purpose of securely holding it thereof;
- iii) at least one door to allow access to said interior compartment;
- iv) whereby said cabinet can be modularly stacked onto a toilet water tank;
- v) whereby a plurality of said cabinets can be modularly stacked onto a toilet water tank;

b) a bidet system mounted inside said interior compartment of said cabinet, comprising:
- i) an inlet cold water line that is coupled with the toilet tank water line for transporting water under pressure to said bidet system;
- ii) an electrical connection to a standard power receptacle to the outside of said cabinet;
- iii) an optional device for heating water;
- iv) a water tubing that fluidly connects said cold water inlet line to said water heating device;
- v) at least one water mixing valve;
- vi) a water tubing that fluidly connects said cold water inlet line to said mixing valve;
- vii) a flexible water hose system, comprising:
  - (1) optional electrical conductors embedded inside the jacket of said water hose;
  - (2) an optional electronic control mechanism as mounted at the bidet sprayer end of said water hose, comprising:
    - (a) switches to adjust water temperature;
    - (b) switches for preselecting programmed temperatures;
    - (c) switches for dispensing a solution from a liquid dispenser into said bidet water hose;
    - (d) a water temperature probe in close proximity to the interior of said water hose to measure water temperature;
    - (e) means for displaying said water hose water temperature;
    - (f) means for controlling said water mixing valve(s) to adjust water temperature;
    - (g) means for controlling said water mixing valve (s) to dispense a solution into said water hose;
    - (h) whereby said electronic control mechanism monitors, displays and controls the temperature of water;
    - (i) whereby said electronic control mechanism can dispense a solution from a liquid dispenser into said water hose;
  - (3) whereby said water hose system control mechanism can monitor, display and control the temperature of water flowing through said hose system;
  - (4) whereby said water hose system control mechanism can control the dispensing of a solution from a liquid dispenser into said bidet water hose;
- viii) a water tubing that fluidly couples output lines of said mixing valve to said water hose system thereby allowing the fluid communication of liquid(s) from said mixing valve to water output end of said water hose system;
- ix) a replaceable bidet water sprayer, comprising:
  - (1) a fixed or adjustable spray nozzle;
  - (2) whereby a desired pattern and flow of water can be sprayed from said sprayer;
- x) a tensioned hose reel system, comprising:
  - (1) a length of said flexible water hose coiled around said hose reel;
  - (2) a revolving reel to deploy said water hose upon pulling on said water hose;
  - (3) whereby said hose can be uncoiled and automatically recoiled onto said hose reel;
- xi) whereby said bidet system can monitor, display and control the temperature of water;
- xii) whereby said bidet system can dispense a liquid into said bidet water sprayer;
- xiii) whereby said bidet system can dispense a solution into said bidet water sprayer from a liquid dispenser;
- xiv) whereby said bidet system can produce a desired pattern and flow of water spray;
- xv) whereby said bidet system can be uncoiled and automatically recoiled into said interior compartment of said cabinet;

c) A cartridge based liquid dispensing system that can dispense at least one type of liquid into said bidet system and/or into said toilet tank, comprising:
- i) at least one liquid pump;
- ii) at least one removable cartridge that can contain liquid;
- iii) a means for conveying liquid from said cartridge to said liquid pump when said cartridge is joined with said liquid pump;
- iv) a means to control the activation of said liquid dispensing system;
- v) whereby a liquid channel is established between said cartridge and said liquid pump when said cartridge is joined with said liquid pump;
- vi) whereby said liquid pump can activate as necessary to dispense liquid from said cartridge to a depository;

d) an air blow-dryer system mounted in said interior compartment of said cabinet, comprising:
- i) an electrical connection to a standard power outlet to the outside of said modular cabinet;
- ii) a tensioned cord reel system, comprising:

(1) a length of flexible electrical cord coiled around said cord reel;

(2) a revolving reel to deploy said electrical cord upon pulling on electrical cord;

(3) whereby said cord can be uncoiled and automatically recoiled onto said cord reel;

iii) an air blow-dryer device attached to the end of said cord from said cord reel;

iv) whereby said blow-dryer can be coiled and automatically recoiled into said interior of said cabinet;

v) whereby said blow-dryer is powered;

e) whereby said bidet system's cabinet can be modularly installed onto a toilet water tank;

f) whereby said bidet system can dispense said toilet tank inlet water and/or a solution from said cartridge into said bidet sprayer;

g) whereby said bidet system can monitor, display and control the temperature of bidet spray solution;

h) whereby said bidet system can produce a desired pattern and flow of water spray;

i) whereby said bidet system can be uncoiled and automatically recoiled into said interior compartment of said cabinet;

j) whereby said bidet system's blow-dryer can be coiled and automatically recoiled into said interior of said cabinet.

2. The modular bidet system according to claim 1, whereby a means for conveying liquid from said cartridge to said liquid pump when said cartridge is joined with said liquid pump is a valve mechanism, comprising:

a) a cartridge drain deposed on said cartridge to allow liquid to flow from said cartridge, comprising:

i) a liquid drain valve that can open to release liquid from said cartridge drain;

ii) a tensioned mechanism on said drain valve to keep said drain valve normally closed while said cartridge is removed from said liquid pump;

iii) whereby said drain valve can be opened to allow liquid flow, and closed to prevent liquid flow from said cartridge drain;

b) a liquid inlet orifice deposed in said liquid pump to provide the flow of liquid from said cartridge into said liquid pump, comprising:

i) a valve actuator deposed on said inlet orifice of said liquid pump that is positioned to engage said drain valve in said cartridge when said cartridge is joined with said liquid pump to automatically open said drain valve;

c) whereby said drain valve in said cartridge can be automatically opened or closed upon joining or separating said cartridge from said liquid pump;

d) whereby liquid contained in said cartridge can be conveyed to said liquid pump once said cartridge is joined with said liquid pump.

3. The modular bidet system according to claim 1, whereby said means to control the activation of said liquid dispensing system and said means to optionally flush said toilet is an electric system, comprising:

a) an optional display for programming and status indication;

b) optional lamps and buzzers for system device status;

c) optional switches for selecting preprogrammed functions and for programming;

d) electric circuit inputs and outputs to monitor and control said dispensing system;

e) means for controlling at least one said liquid pump to dispense a specified output volume of liquid for each flush cycle;

f) means for controlling at least one said liquid pump to dispense a specified output volume for a specified programmed timed interval;

g) means for controlling said optional automatic toilet flushing system;

h) a power supply;

i) whereby a user can have control over said dispensing system and said optional automatic flushing system;

j) whereby said electric circuit has the means to monitor input signals and drive output signals for system control and automation.

4. The modular bidet system according to claim 1, whereby said cabinet housing is a modular chassis that attaches onto said toilet water tank that is shaped to fit and blend in with said water tank.

5. The modular bidet system according to claim 1, whereby a plurality of cartridges and liquid pumps can be used to dispense a plurality of liquid types.

6. The modular bidet system according to claim 1, whereby said cartridge can be refillable and reusable, or can be non-refillable and disposable.

7. The modular bidet system according to claim 1, whereby said liquid dispensing system uses a single or plurality of fixed-mounted or removable tanks to store dispensing liquid instead of removable cartridges.

8. The modular bidet system according to claim 1, whereby said components that are mounted inside said cabinet are instead mounted into separate cabinets, thereby allowing said separate cabinets to be used individually or used in any combination as modularly stacked together to form a functioning unit.

9. The modular bidet system according to claim 1, whereby said cabinet housing is shaped in a generic, universal chassis and provided with adjustable guides to enable a single chassis shape to fit a wide variety of water tank shapes and designs.

10. The modular bidet system according to claim 1, whereby said cabinet housing can be configured to use said stock toilet tank lid, a custom lid, or an integral lid.

11. The modular bidet system according to claim 1, whereby said inlet cold water line that is coupled with the toilet tank water line uses a quick-disconnect style coupling.

12. The modular bidet system according to claim 1, whereby said liquid dispenser system can be configured to deliver liquid into a toilet water tank.

13. The modular bidet system according to claim 1, any of its components in part or in total is manufactured in combination with a new toilet.

* * * * *